US010774564B2

(12) United States Patent
Naka

(10) Patent No.: US 10,774,564 B2
(45) Date of Patent: Sep. 15, 2020

(54) DOOR HANDLE DEVICE

(71) Applicant: U-SHIN LTD., Tokyo (JP)

(72) Inventor: Atsushi Naka, Hiroshima (JP)

(73) Assignee: U-SHIN LTD., Tokyo (JP)

( * ) Notice: Subject to any disclaimer, the term of this patent is extended or adjusted under 35 U.S.C. 154(b) by 654 days.

(21) Appl. No.: 15/220,965

(22) Filed: Jul. 27, 2016

(65) Prior Publication Data

US 2017/0030107 A1 Feb. 2, 2017

(30) Foreign Application Priority Data

Jul. 29, 2015 (JP) ..... 2015-149779
Jul. 29, 2015 (JP) ..... 2015-149784

(51) Int. Cl.

| | |
|---|---|
| ***E05B 15/00*** | (2006.01) |
| ***E05B 7/00*** | (2006.01) |
| ***E05B 85/16*** | (2014.01) |
| ***E05B 77/36*** | (2014.01) |

(52) U.S. Cl.

CPC ..... *E05B 15/0006* (2013.01); *E05B 7/00* (2013.01); *E05B 77/36* (2013.01); *E05B 85/16* (2013.01)

(58) Field of Classification Search

CPC ..... E05B 15/0006; E05B 85/16; E05B 77/36; E05B 7/00

USPC ..... 70/207, 208, DIG. 58, DIG. 67

See application file for complete search history.

(56) References Cited

U.S. PATENT DOCUMENTS

| | | | | |
|---|---|---|---|---|
| 10,145,155 | B2 * | 12/2018 | Mathofer | E05B 85/10 |
| 2011/0233945 | A1 * | 9/2011 | Koizumi | E05B 77/06 292/336.3 |
| 2013/0134723 | A1 | 5/2013 | Yokoyama et al. | |
| 2014/0117683 | A1 | 5/2014 | Saitou | |

FOREIGN PATENT DOCUMENTS

| | | |
|---|---|---|
| CN | 103132782 | 6/2013 |
| DE | 10 2009 043 933 | 3/2011 |
| JP | 2001-132283 | 5/2001 |
| JP | 2007-32257 | 2/2007 |
| JP | 2012-246669 | 12/2012 |
| JP | 2014-136873 | 7/2014 |

* cited by examiner

*Primary Examiner* — Kristina R Fulton
*Assistant Examiner* — Thomas L Neubauer
(74) *Attorney, Agent, or Firm* — Wenderoth, Lind & Ponack, L.L.P.

(57) ABSTRACT

Provided is a door handle device which can prevent rattling of a handle grip using an existing base member. A door handle device includes: a base member having a first shaft portion or a first bearing portion formed on one end side thereof, and having a guide hole which has a restricting portion projecting into an inner space formed on the other end side thereof; a handle grip having a second bearing portion which rotatably supports the first shaft portion or a second shaft portion which is rotatably supported by the first bearing portion on one end side thereof, and having an inserting portion advanceable into and retractable from the guide hole formed on the other end side thereof; and a slide guide having a slide contact portion which is brought into slide contact with the restricting portion.

12 Claims, 24 Drawing Sheets

Flg. 13B
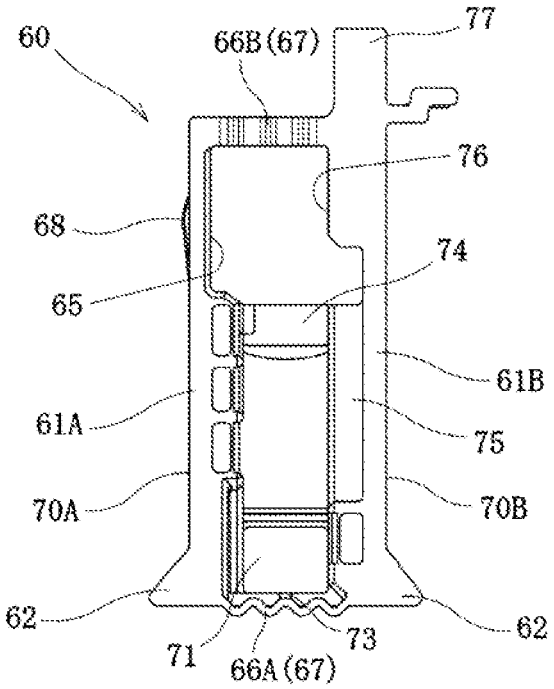

DOOR HANDLE DEVICE

CROSS-REFERENCE TO RELATED APPLICATIONS

This application claims priority from Japanese Patent Application Nos. 2015-149779 and 2015-149784, the disclosures of which are incorporated herein by reference in their entireties.

BACKGROUND OF THE INVENTION

Field of the Invention

The present invention relates to a door handle device for a vehicle.

Description of Related Art

A door handle device includes a handle grip which a user grips. The handle grip includes a pivotally-mounting portion on one end side thereof, which is pivotally supported on a base member, and an inserting portion on the other end side thereof, which is inserted into a guide hole formed in the base member. When the handle grip is manipulated so as to open a door, the inserting portion moves into the guide hole. Accordingly, a predetermined gap is formed between the inserting portion and a wall of the guide hole so as to enable the movement of the inserting portion in the guide hole. This gap causes rattling which is fine movement of the handle grip in a direction along an axis of rotation.

JP-A-2007-32257 (patent document 1) discloses a door handle device where a guide member with which an inserting portion of a handle grip is brought into slide contact is disposed in a guide hole formed in a base member. By restricting the movement of the inserting portion of the handle grip along an axis of rotation by the guide member, rattling of the handle grip with respect to the base member is prevented.

SUMMARY OF THE INVENTION

However, in the door handle device disclosed in patent document 1, it is necessary to form a fixing portion on the base member for fixing the guide member. Accordingly, it is necessary to newly provide a mold for forming the base member and hence, a manufacturing cost is pushed up. To describe the situation in more detail, in the door handle device, in changing a design of a handle grip, there may be a case where an existing product is reused for the base member. However, when the structure disclosed in patent document 1 is newly adopted, it is also necessary to change a design of the base member.

The present invention has been accomplished in view of the above circumstances, and it is an object of the present invention to provide a door handle device which can prevent rattling of the handle grip using an existing base member.

In order to solve the problem mentioned above, the present invention provides a door handle device including:

a base member having a first shaft portion or a first bearing portion formed on one end side thereof, and having a guide hole which has a restricting portion projecting into an inner space formed on the other end side thereof;

a handle grip having a second bearing portion or a second shaft portion which provides a rotatably mounting state for the handle grip between the first shaft portion or the first bearing portion and the second shaft portion or the second bearing portion formed on one end side thereof, and having an inserting portion advanceable into and retractable from the guide hole formed on the other end side thereof; and a slide guide mounted on the handle grip, and having a slide contact portion which is brought into slide contact with the restricting portion.

In the door handle device, by mounting the slide guide having the slide contact portion which is brought into slide contact with the restricting portion of the base member on the inserting portion of the handle grip, rattling of the handle grip with respect to the base member can be prevented. Rattling of the handle grip can be prevented by merely mounting the slide guide on the existing handle grip and hence, a change in design of the base member becomes unnecessary whereby a design of the handle grip can be changed while a manufacturing cost is held down.

One of the inserting portion and the slide guide of the handle grip has a fixing convex portion, and the other one has a fixing concave portion into which the fixing convex portion is press-fitted, a mounting direction along which the second bearing portion or the second shaft portion of the handle grip is mounted on the first shaft portion or the first bearing portion of the base member is the direction which intersects with the advancing and retracting direction of the inserting portion into and from the guide hole, and a press-fitting direction of the fixing convex portion into the fixing concave portion intersects with the mounting direction.

With such a configuration, even when the slide guide mounted on the handle grip is brought into contact with the base member at the time of mounting the handle grip on the base member, the direction of a force which acts on the base member in this case intersects with the press-fitting direction of the fixing convex portion along which the fixing convex portion is press-fitting into the fixing concave portion and hence, the removal of the slide guide from the handle grip can be prevented.

The slide guide includes: a pair of side frames respectively disposed along a projecting direction of the inserting portion; and a connecting portion which connects the pair of side frames to each other, and the side frame has one of the fixing convex portion and the fixing concave portion.

With such a configuration, the slide guide is formed of a single body formed by connecting the pair of side frames to each other by the connecting portion and hence, a part management is facilitated. Further, the slide guide can be integrally formed by molding and hence, a manufacturing cost can be lowered.

The connecting portion has an extending and shrinking portion.

With such a configuration, in the slide guide, a distance between the pair of side frames can be changed freely. Accordingly, enhancement of mounting operability can be achieved including ensuring a space which allows press-fitting of the fixing convex portion into the fixing concave portion at the time of mounting the slide guide on the inserting portion of the handle grip.

The inserting portion of the handle grip includes a positioning convex portion extending along a projecting direction of the inserting portion, the positioning convex portion being formed into a rectangular shape in cross section and having a first side surface and a second side surface, and the side frame of the slide guide has a first positioning portion which is brought into contact with the first side surface of the positioning convex portion on one end side, and a second positioning portion which is brought into contact with the second side surface of the first positioning convex portion on the other end side.

With such a configuration, by bringing the first positioning portion and the second positioning portion of the slide guide into contact with both side surfaces of the positioning convex portion of the handle grip, the mounting state of the slide guide can be made stable. Accordingly, even when an external force is applied to the slide guide, the positional displacement or the removal of the slide guide from the handle grip can be suppressed.

The handle grip is rotatable about the shaft portion between a non-manipulation position where the handle grip extends along the base member and a manipulation position where the handle grip is away from the base member, and the slide contact portion of the slide guide is elastically brought into contact with the restricting portion when the handle grip is at the non-manipulation position, and the slide contact portion of the slide guide is brought into a non-contact state with the restricting portion as the handle grip is rotated to the manipulation position.

With such a configuration, rattling of the handle grip positioned at the non-manipulation position can be prevented. Further, when the handle grip is in a manipulated state, the slide contact portion of the slide guide is not in contact with the restricting portion of the base member. Accordingly, slide resistance which the slide guide receives from the base member can be reduced and hence, there is no possibility that manipulability of the handle grip is impaired.

The base member and the handle grip are disposed such that an axis of the shaft portion extends along a vertical direction, and the slide contact portion is capable of being elastically brought into pressure contact only with an upper side of the inserting portion of the handle grip.

With such a configuration, when the handle grip is at the non-manipulation position, the slide contact portion which is mounted only on an upper side of the inserting portion is elastically brought into pressure contact with the restricting portion of the base member. Accordingly, the inserting portion of the handle grip is biased downward so that a lower side of the inserting portion is brought into contact with the restricting portion of the base member. Usually, a user grips the handle grip from above and hence, a downward load is applied to the handle grip. In such an operation, there is no gap below the inserting portion of the handle grip and hence, the handle grip is maintained in a state where the position of the handle grip is restricted by the restricting portion. Accordingly, there is no possibility that the user who grips the handle grip has a sensation of rattling. Further, even when the user moves the handle grip in an upper direction in such a state, the slide contact portion having elasticity is brought into contact with the restricting portion of the base member and hence, rattling can be suppressed.

The slide guide includes a pair of side frames disposed on both sides of the inserting portion, and a connecting portion which connects the pair of side frames to each other, and the side frame has the contact portion, and the slide contact portion which projects from the contact portion.

With such a configuration, assuming that the handle grip is at the manipulation position, even when a load is applied to the handle grip in a direction along an axis of rotation, the contact portion is brought into contact with the restricting portion and hence, breakage of the bearing portion can be prevented. Further, the inclination of the handle grip in the direction toward the axis of rotation of the handle grip can be suppressed. Further, the contact portion is brought into slide contact with the restricting portion at the time of manipulating the handle grip and hence, the handle grip can be guided to the manipulation position with certainty. Further, the slide contact portion which is brought into contact with the restricting portion at the non-manipulation position and the contact portion which is brought into contact with the restricting portion at the manipulation position are formed by integral molding as slide guides disposed on the inserting portion body of the handle grip and hence, the number of parts for forming the handle grip can be reduced.

The slide guide is made of a material which exhibits lower slide resistance against the restricting portion than the inserting portion exhibits.

With such a configuration, slide resistance at the time of manipulating the handle grip can be reduced and hence, the manipulability of the handle grip can be enhanced with certainty.

A manipulating portion which is configured to engage with a lever member rotatably and pivotally supported by the base member and to manipulate the lever member is mounted on the inserting portion of the handle grip, and a cover portion which covers the manipulating portion is integrally formed with the slide guide.

With such a configuration, the door handle device includes the cover portion which covers the manipulating portion of the inserting portion body of the handle grip and hence, wear on the lever member can be suppressed. Further, the cover portion is integrally formed with the slide guide and hence, it is possible to prevent the increase of the number of parts and the increase of a manufacturing cost.

According to the door handle device of the present invention, the slide guide having the slide contact portion which is brought into slide contact with the restricting portion of the base member is disposed in the inserting portion of the handle grip. Accordingly, rattling of the handle grip with respect to the base member can be prevented. Further, an existing base member can be reused without making any change in design and hence, the increase of a manufacturing cost can be held in check at the time of changing a design of the handle grip.

BRIEF DESCRIPTION OF THE DRAWINGS

The foregoing and the other feature of the present invention will become apparent from the following description and drawings of an illustrative embodiment of the invention in which:

FIG. 13B is a back view of the slide guide;

DETAILED DESCRIPTION OF THE PREFERRED EMBODIMENT

Hereinafter, an embodiment of the present invention is described with reference to drawings.

(Overall Configuration)

Figure 1:
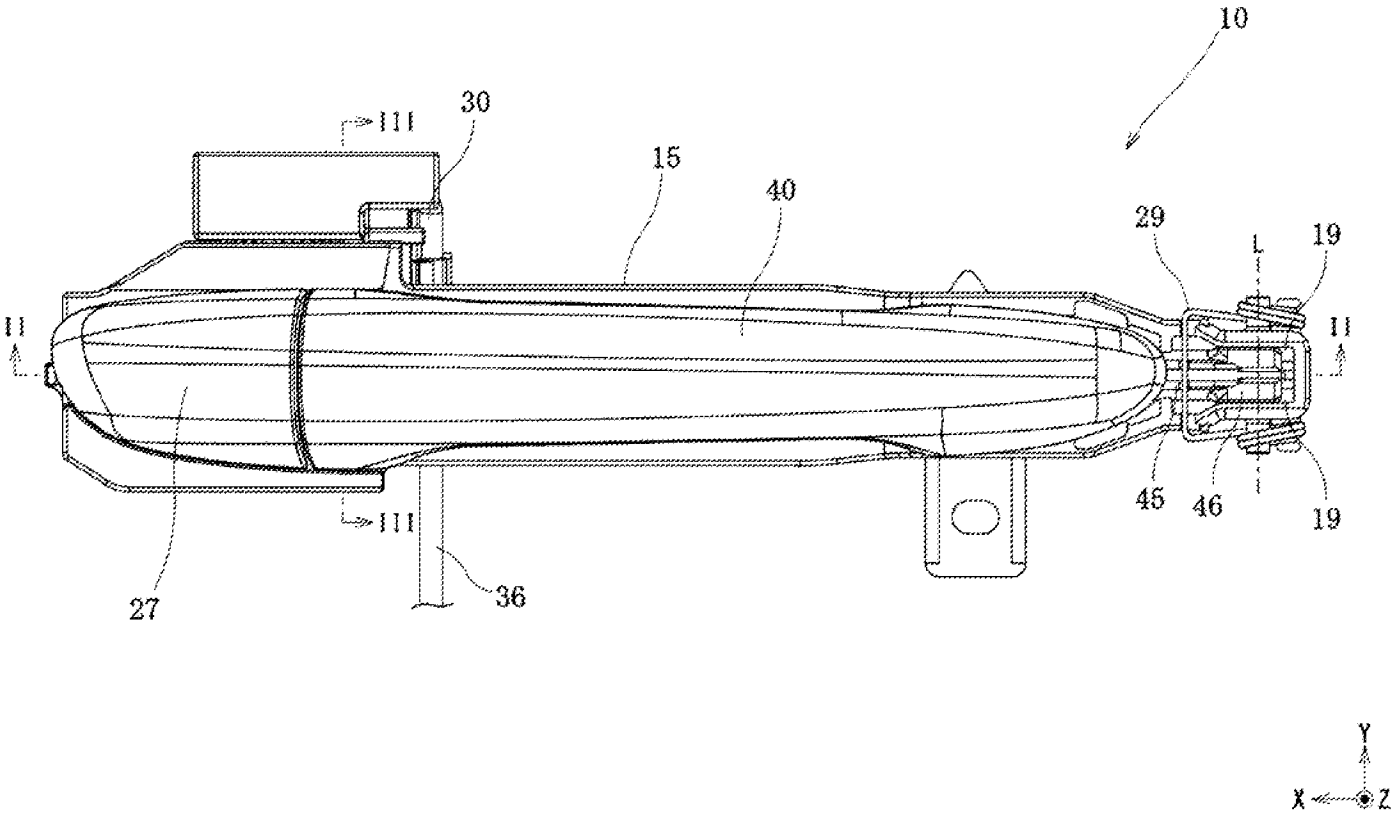
FIG. 1 is a front view of a door handle device.
Figure 2A:
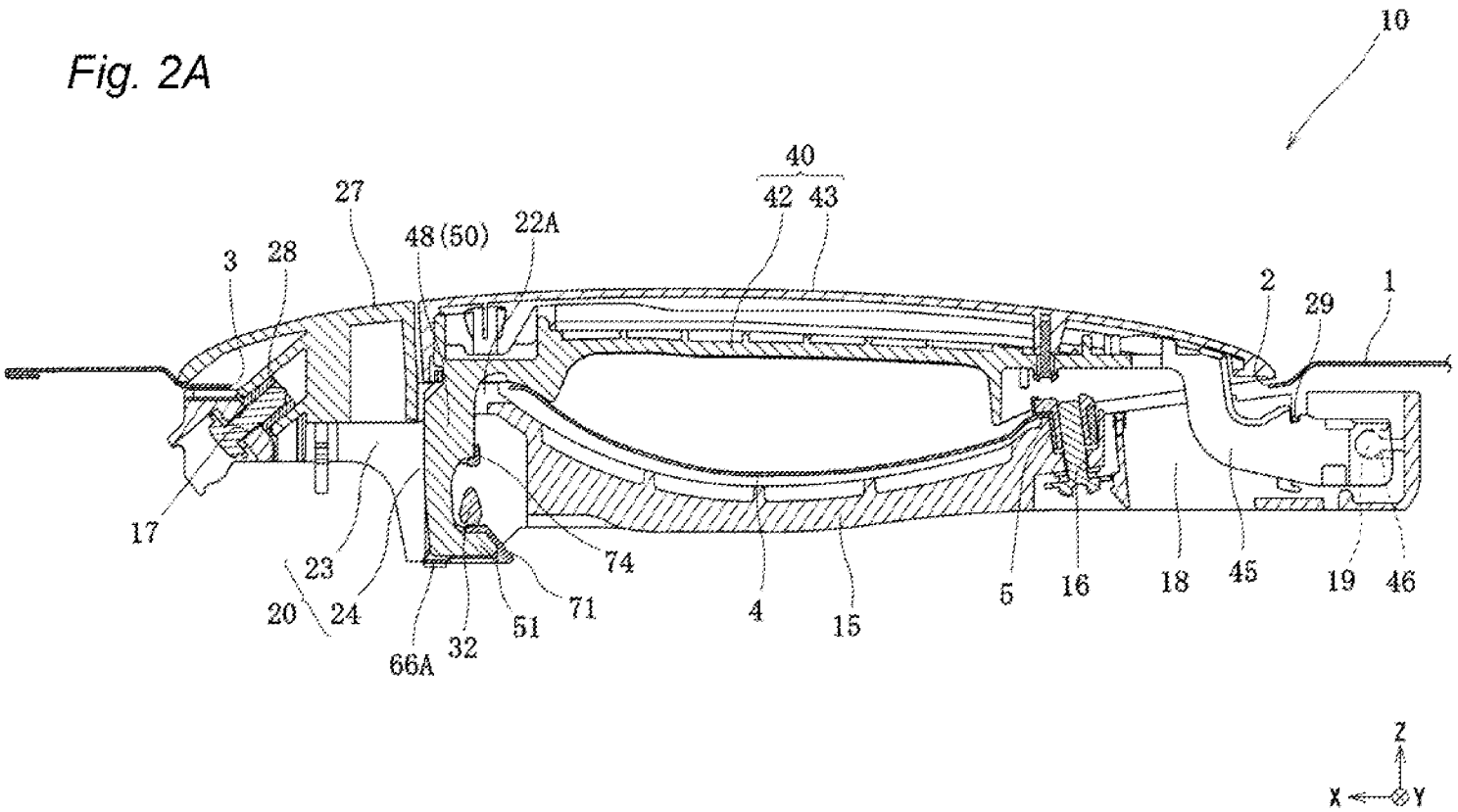
FIG. 2A is a cross-sectional view taken along a line II-II in FIG. 1.
Figure 2B:
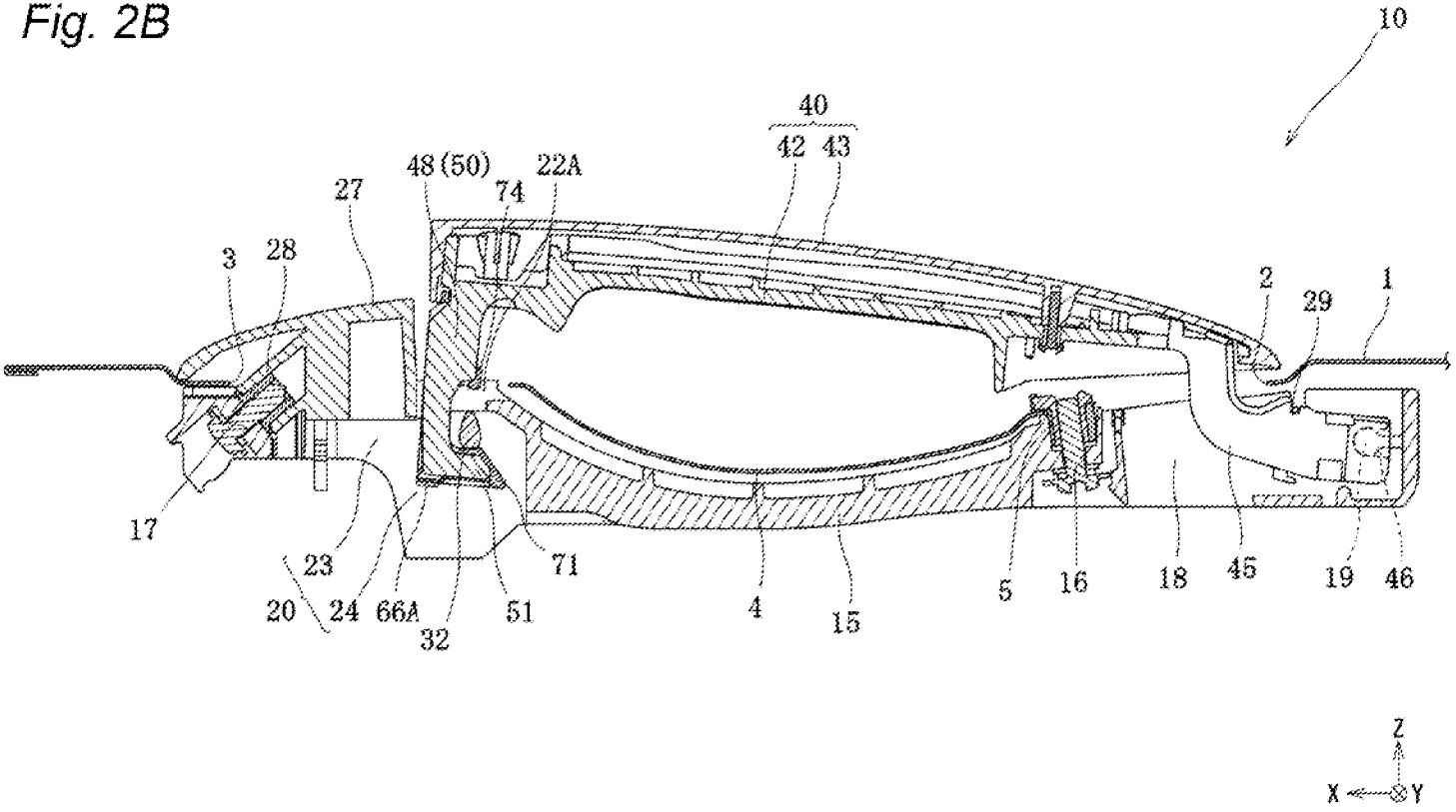
FIG. 2B is a cross-sectional view showing a state where a handle grip is manipulated so as to open a door.
Figure 3:
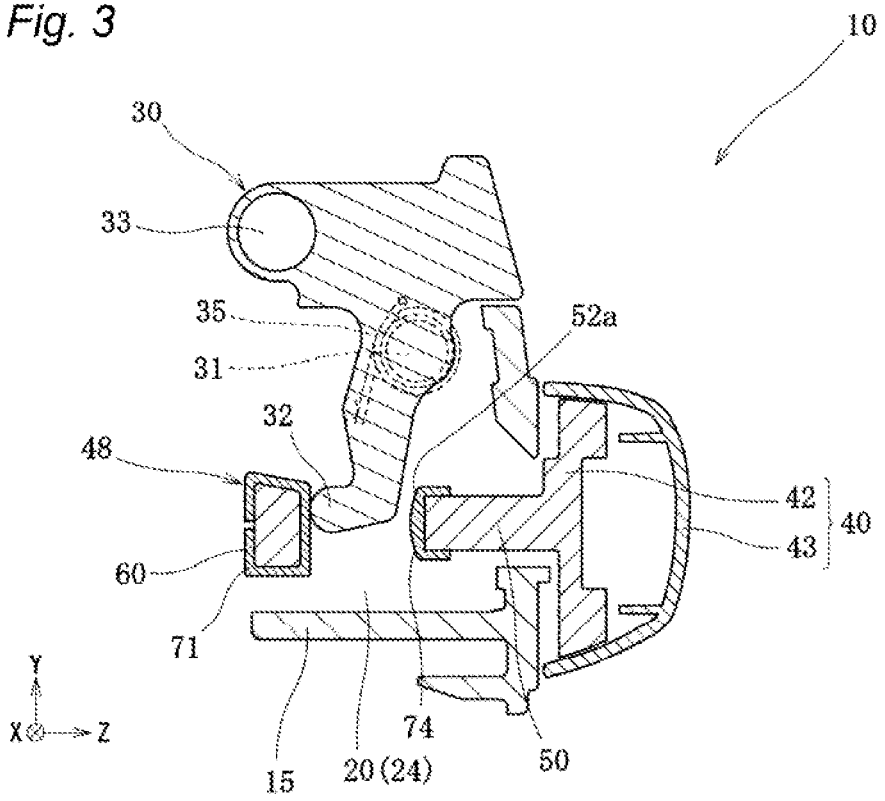
FIG. 3 is a cross-sectional view taken along a line in FIG. 1.

FIG. 1 to FIG. 3 show a door handle device 10 for a vehicle according to the embodiment of the present invention. The door handle device 10 includes: a base member 15 disposed on a door panel 1 shown in FIG. 2A; a lever member 30 rotatably disposed on an upper portion of the base member 15 on a cabin side; and a handle grip 40 rotatably disposed on the base member 15 outside the vehicle. As shown in FIG. 2B, in the door handle device 10, when the handle grip 40 is manipulated in the vehicle-outside direction Z so as to open a door, the lever member 30 is rotated as shown in FIG. 3. With such an operation, a latch mechanism not shown in the drawing which is disposed in the inside of the door is operated by way of a rod 36 shown in FIG. 1 so that the door is opened.

(Detailed Description of Door Panel)

As shown in FIG. 2A, the door panel 1 forms an outer surface of the door. As shown in FIG. 2A, a first opening portion 2 and a second opening portion 3 are formed in the door panel 1 with a predetermined distance therebetween in the longitudinal direction of the door which corresponds to the X direction in FIG. 2A. An arm portion 45 disposed on one end side of the handle grip 40 is inserted into the first opening portion 2 positioned on a right side in FIG. 2A from outside the vehicle. An inserting portion 48 disposed on the other end side of the handle grip 40 is inserted into the second opening portion 3 positioned on a left side in FIG. 2A from outside the vehicle. A curved portion 4 which is recessed in the cabin side direction Z is formed on the door panel 1 between the first opening portion 2 and the second opening portion 3.

(Detailed Description of Base Member)

Figure 4A:
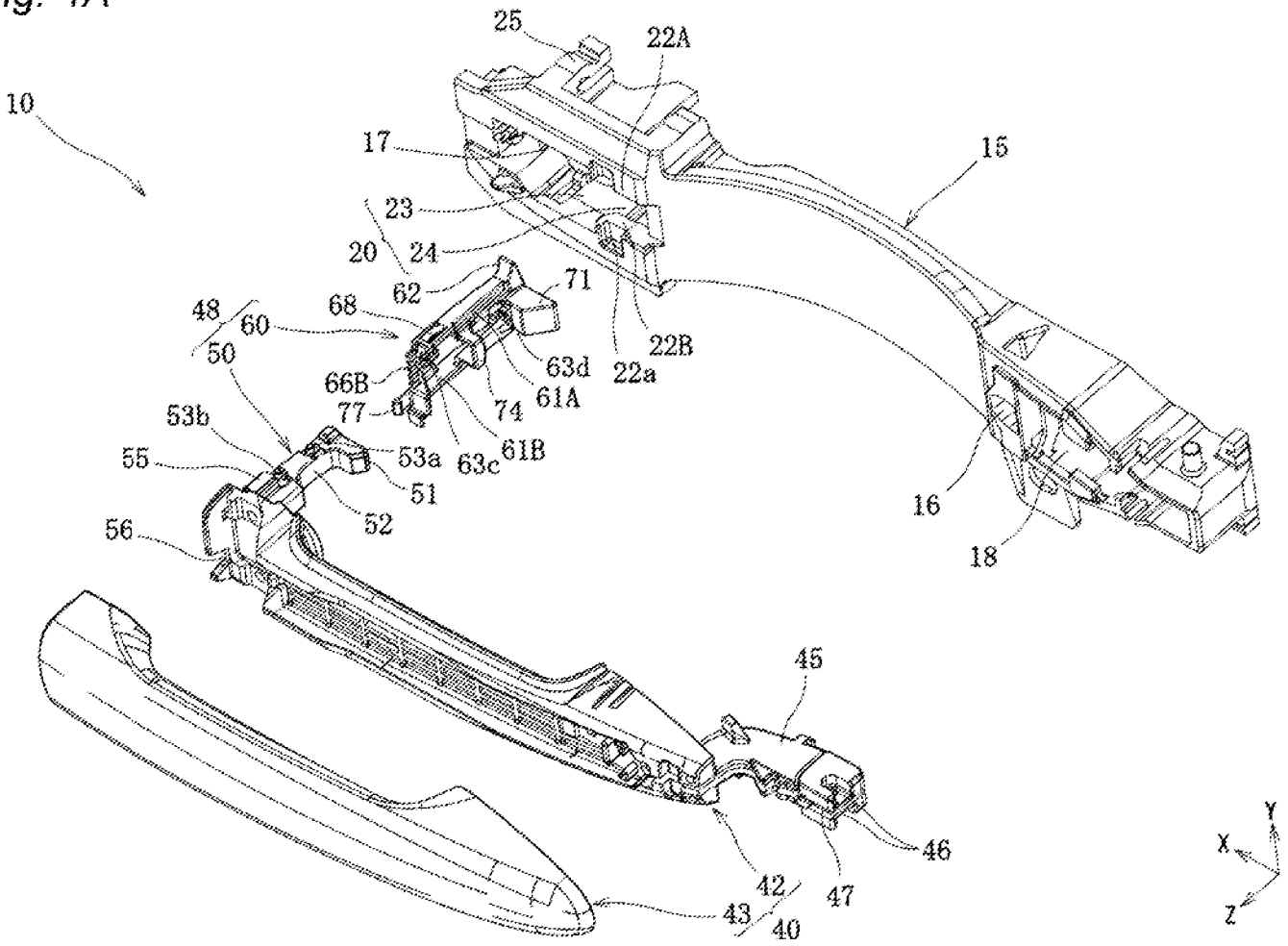
FIG. 4A is an exploded perspective view of the door handle device.
Figure 4B:
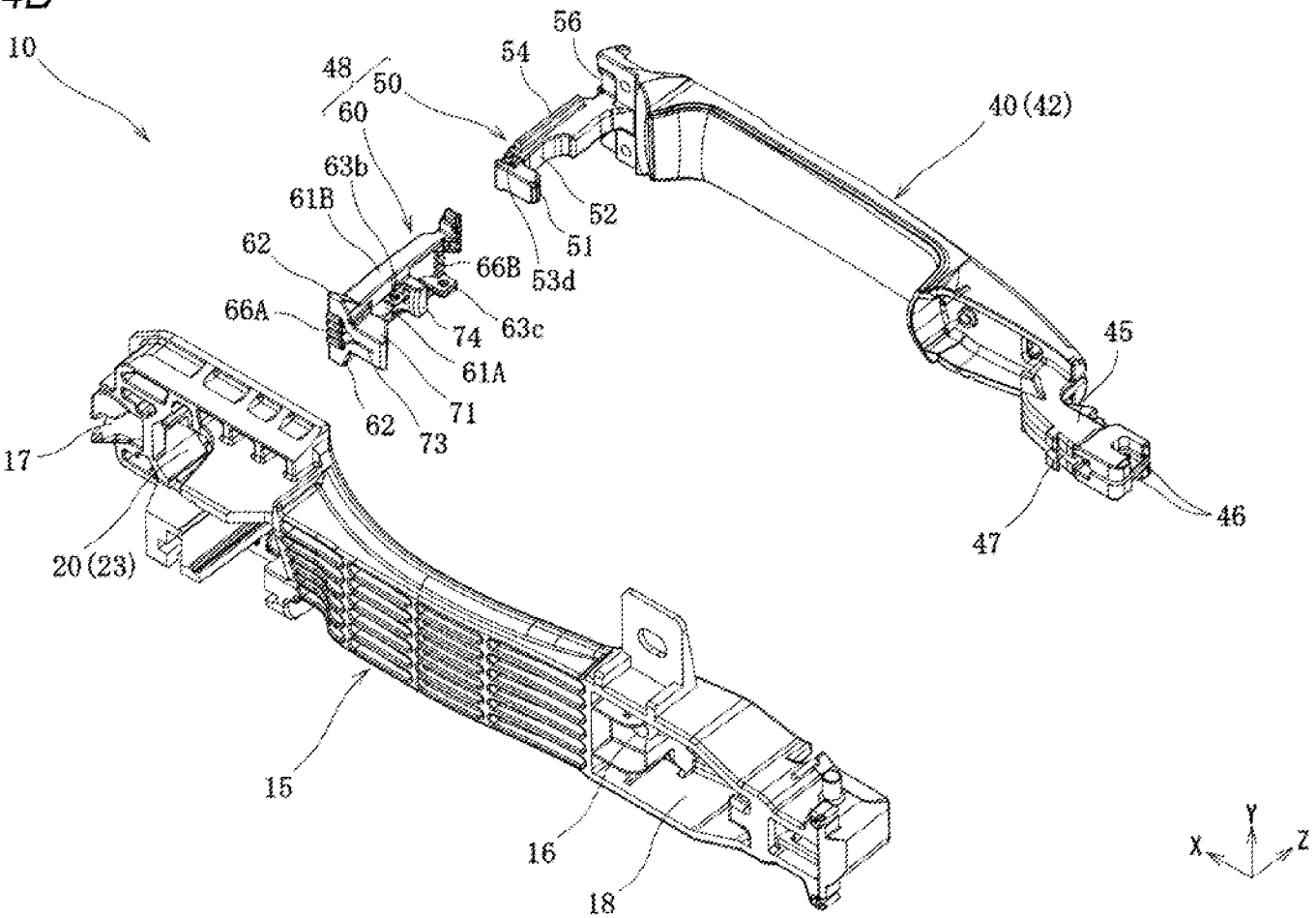
FIG. 4B is an exploded perspective view of the door handle device shown in FIG. 4A excluding a handle cover as viewed from a side opposite to a side from which the handle device is viewed in FIG. 4A.
Figure 5:
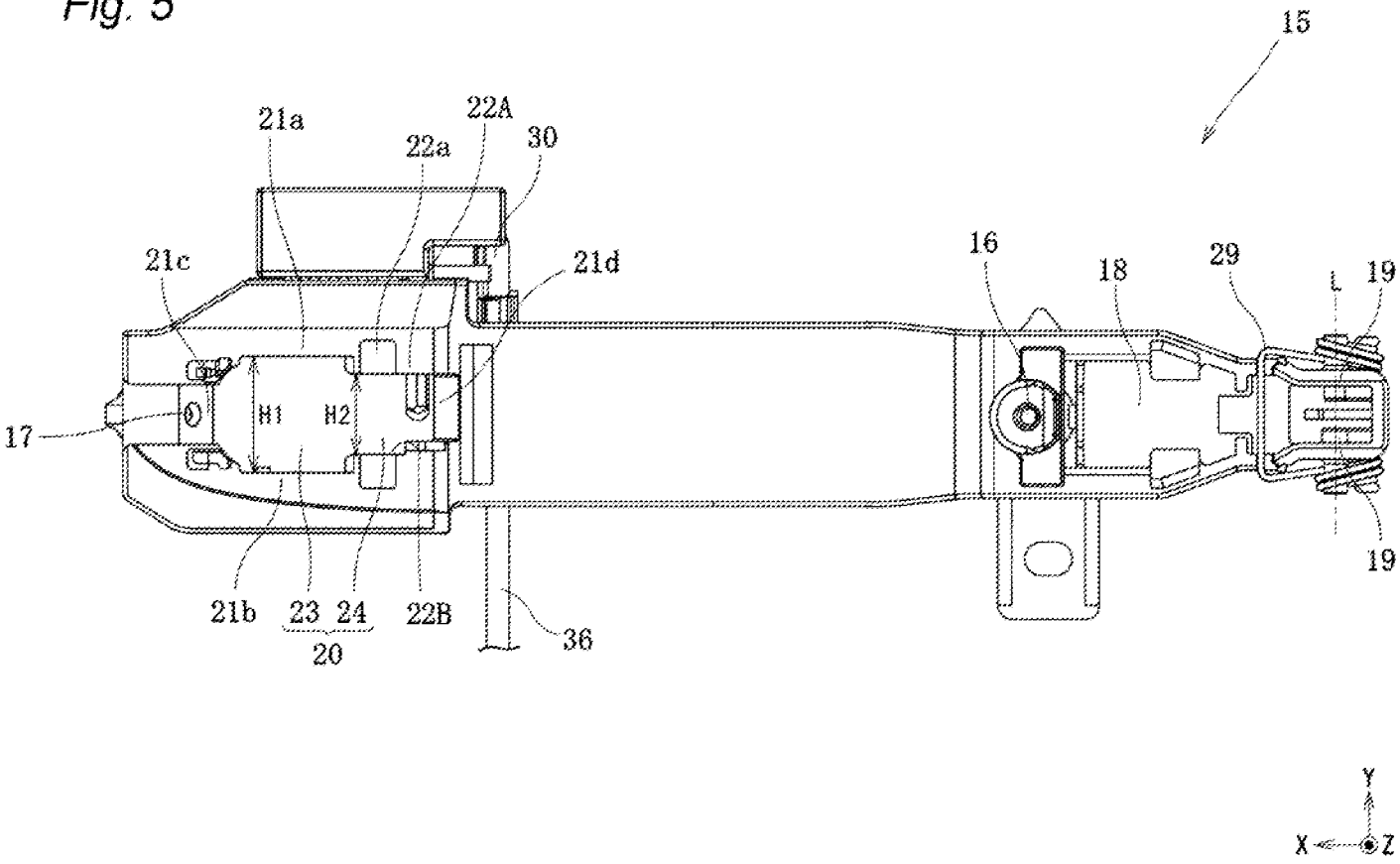
FIG. 5 is a front view of a base member.

To describe the configuration also with reference to FIG. 4A to FIG. 5, the base member 15 has a curved surface which conforms to the curved portion 4 of the door panel 1, and is disposed on the cabin side of the door panel 1. A first screw hole 16 is formed in the base member 15 such that the first screw hole 16 is positioned on the left side of the first opening portion 2. A second screw hole 17 is formed in the base member 15 such that the second screw hole 17 is positioned on the left side of the second opening portion 3. As most clearly shown in FIG. 2A, a screw is made to pass through the first screw hole 16, and is threaded into a screw stopper 5 of the door panel 1 so that the base member 15 is fixed to the door panel 1. Further, a screw is made to pass through the second screw hole 17, and is threaded into a boss 28 of an end cover 27 disposed outside the vehicle of the door panel 1 so that the door panel 1 is fixed in a state where the door panel 1 is sandwiched between the base member 15 and the end cover 27.

In the base member 15, an arm mounting hole 18 which communicates with the first opening portion 2 and in which the arm portion 45 of the handle grip 40 is disposed is formed. The arm mounting hole 18 is defined by walls of the base member 15. Shaft portions 19 on which the handle grip 40 is rotatably mounted are formed on the base member 15 such that the shaft portions 19 project into the inside of the arm mounting hole 18 from a wall of the base member 15 disposed on the right side in FIG. 2A. As most clearly shown in FIG. 5, the shaft portions 19, 19 which form a pair are formed on the base member 15 with a predetermined distance therebetween such that the shaft portions 19, 19 project from the wall of the base member 15 disposed on a right side in FIG. 5. The base member 15 is disposed on the door panel 1 such that an axis of rotation (axis) L of the shaft portions 19 (handle grip 40) extends in the vertical direction Y of the door in FIG. 5. A biasing spring 29 which suppresses rattling of the handle grip 40 in the longitudinal direction X is disposed on the shaft portions 19.

A guide hole 20 is also formed in the base member 15 such that the guide hole 20 is positioned at an end portion of the base member 15 on a side opposite to the shaft portion 19. The guide hole 20 communicates with the second opening portion 3, and the inserting portion 48 of the handle grip 40 is disposed in the guide hole 20. The guide hole 20 is defined by an upper wall 21*a*, a lower wall 21*b*, and a pair of lateral walls 21*c*, 21*d*. The guide hole 20 extends along the vehicle inside-and-outside direction Z, and penetrates the base member 15. To describe the configuration also with reference to FIG. 7A, the restricting portions 22A, 22B which restrict the movement of the inserting portion 48 of the handle grip 40 in the vertical direction along the axis of rotation L are formed on a shaft portion 19 side of the guide hole 20. The restricting portions 22A, 22B respectively project from vehicle-outside end portions of the upper wall 21*a* and the lower wall 21*b* of the guide hole 20 in the vertical direction Y such that the restricting portions 22A, 22B opposedly face each other. A recessed portion 22*a* for fixing a handle seat not shown in the drawing is respectively formed on a surface of the restricting portion 22A on the vehicle-outside side and on a surface of the restricting portion 22B on the vehicle-outside side.

As most clearly shown in FIG. 5, the guide hole 20 is divided into an insertion allowing portion 23 having no projecting restricting portions 22A, 22B, and a guide portion 24 having the projecting restricting portions 22A, 22B. The insertion allowing portion 23 is disposed adjacently to the guide portion 24 on a side opposite to the shaft portions 19. In the insertion allowing portion 23, a groove width in the vertical direction Y of the groove defined by the upper wall 21*a* and the lower wall 21*b* is H1, and the groove width H1 is larger than a maximum size of the inserting portion 48 of the handle grip 40 in the vertical direction Y. A groove width in the vertical direction Y of a portion of the guide portion 24 where the restricting portions 22A, 22B are formed is H2, and the groove width H2 is smaller than the maximum size of the inserting portion 48 in the vertical direction Y. The groove width of the guide portion 24 on the cabin side is equal to the groove width H1 of the insertion allowing portion 23. The inserting portion 48 of the handle grip 40 is disposed in the insertion allowing portion 23 of the guide hole 20 by insertion initially and, thereafter, the handle grip 40 can be slid into the shaft portion 19 side (in the mounting direction) so that the inserting portion 48 is disposed in the guide portion 24.

(Detailed Description of Lever Member)

As shown in FIG. 3, the lever member 30 includes a rotary shaft 31 which projects along the longitudinal direction X of the door, and is rotatably mounted on a bearing 25 of the base member 15 (see FIG. 4A). A return spring (biasing member) 35 which biases the lever member 30 to a non-manipulation position shown in FIG. 3 is disposed on the rotary shaft 31. A manipulation receiving portion 32 which projects into the guide hole 20 is formed on a lower portion of the lever member 30. A rod connection hole 33 which allows the rod 36 to be rotatably connected to the lever member 30 is formed in an upper portion of the lever member 30.

When the manipulation receiving portion 32 of the lever member 30 receives the manipulation of the handle grip 40 so as to open a door, the lever member 30 is rotated in the counterclockwise direction in FIG. 3 against a biasing force of the return spring 35. With such a rotation, an opening operation of the latch mechanism is performed by way of the rod 36. When the manipulation of the handle grip 40 so as to open a door is stopped, the lever member 30 is rotated to the non-manipulation position by a biasing force of the return spring 35. With such an operation, the handle grip 40 is biased to the non-manipulation position by way of the lever member 30.

(Detailed Description of Handle Grip)

Figure 6:
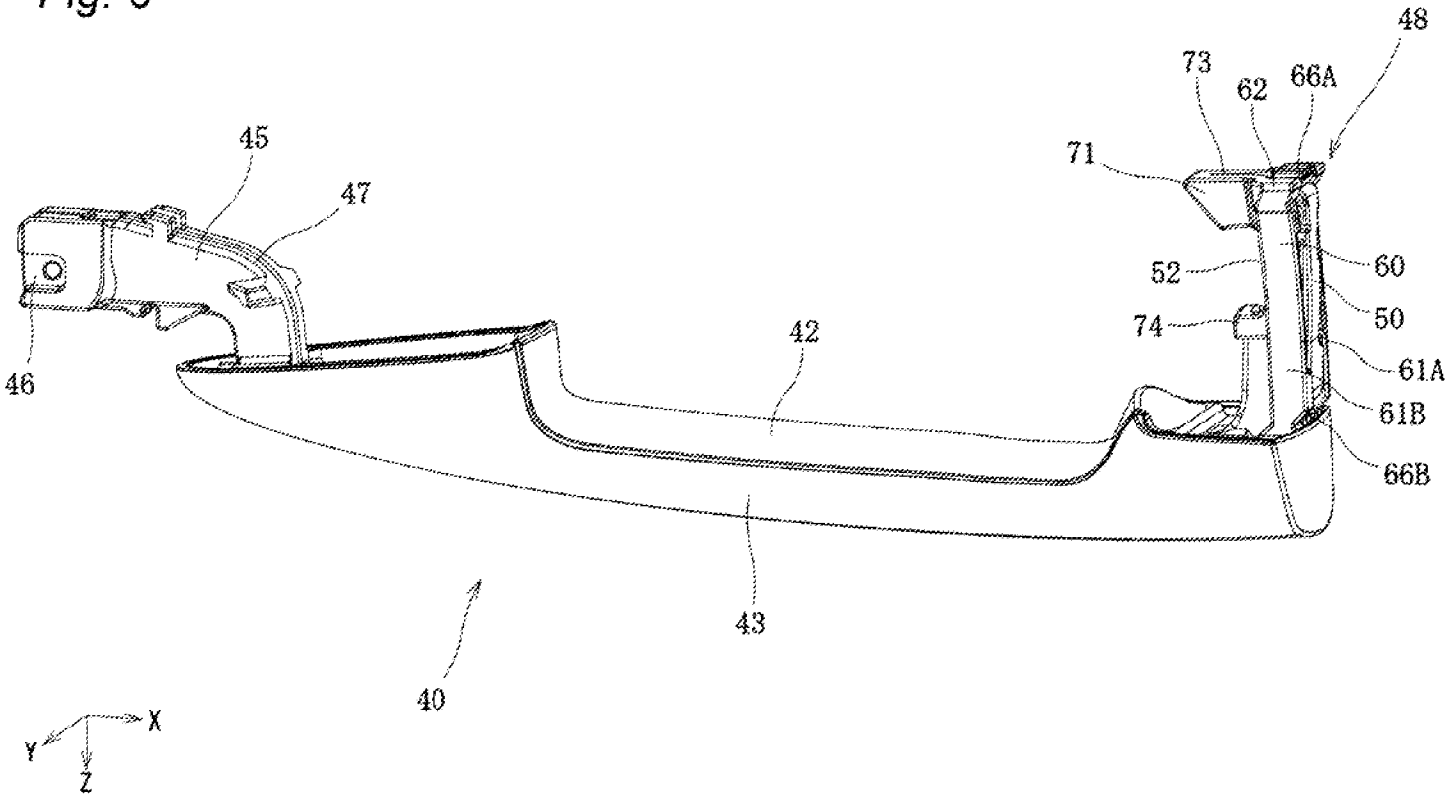
FIG. 6 is a perspective view of the handle grip.

To describe the configuration with reference to FIG. 2A to FIG. 4B together with FIG. 6, the handle grip 40 is disposed outside the vehicle with respect to the base member 15 with the door panel 1 interposed between the handle grip 40 and the base member 15. In this embodiment, in the handle grip 40, by mounting a slide guide 60 which is formed as a separate body on an inserting portion body 50 disposed in the guide hole 20 formed in the base member 15, rattling of the handle grip 40 with respect to the base member 15 is suppressed and manipulability is also enhanced.

As most clearly shown in FIG. 4A, the handle grip 40 includes: a grip body 42 which is mounted along the base member 15; and a handle cover 43 which covers a surface of the grip body 42 on the vehicle-outside side. An antenna (not shown in the drawing) for receiving operation signals from a remote controller is disposed in an inner space formed between the grip body 42 and the handle cover 43. The handle grip 40 is mounted on the base member 15 after the antenna and the handle cover 43 are mounted on the grip body 42.

One end of the handle grip 40 is positioned in the arm mounting hole 18 formed in the base member 15 through the first opening portion 2 of the door panel 1, and the other end of the handle grip 40 is positioned in the guide hole 20 formed in the base member 15 through the second opening portion 3 of the door panel 1. The handle grip 40 is rotatably disposed with respect to the base member 15 such that the handle grip 40 is rotatable between the non-manipulation position shown in FIG. 2A which the handle grip 40 takes before the handle grip 40 is manipulated and a manipulation position shown in FIG. 2B which the handle grip 40 takes after the handle grip 40 is manipulated. The handle grip 40 disposed at the non-manipulation position is positioned with a predetermined gap interposed between the handle grip 40 and the curved portion 4 of the door panel 1.

The grip body 42 includes an approximately L-shaped arm portion 45 disposed in the arm mounting hole 18 through the first opening portion 2. On both surfaces in the vertical direction Y of a distal end of the arm portion 45, bearing portions 46, 46 which support the shaft portions 19, 19 of the base member 15 are formed. To describe the configuration with reference to FIG. 4A and FIG. 4B, each bearing portion 46 is formed of a recessed groove which is recessed in an approximately semi-circular elongated shape, and a distal end of each bearing portion 46 on a shaft portion 19 side in the longitudinal direction X is opened. A splitting slit 47 extending along an XZ plane is formed in the arm portion 45. With the formation of such a splitting slit 47, split members formed by splitting the arm portion 45 in two are elastically movable in the directions along which the split members approach each other.

In mounting the handle grip 40 on the base member 15, the arm portion 45 is inserted into the arm mounting hole 18 formed in the base member 15 through the first opening portion 2 of the door panel 1. Thereafter, the handle grip 40 is slid to the right side in FIG. 2A along the longitudinal direction X (mounting direction) so that the shaft portions 19 of the base member 15 are inserted into the bearing portions 46. With such operations, the handle grip 40 can be rotatably mounted on the base member 15 with the door panel 1 interposed between the handle grip 40 and the base member 15.

As shown in FIG. 2A and FIG. 2B, the grip body 42 includes the inserting portion 48 which projects toward the cabin side of the door panel 1 through the second opening portion 3, and is disposed in the guide hole 20 formed in the base member 15 in an advanceable and retractable manner. To describe the configuration with reference to FIG. 4A and FIG. 4B together with FIG. 6, the inserting portion 48 includes: an inserting portion body 50 integrally formed with the grip body 42; and a slide guide 60 disposed so as to cover the inserting portion body 50. A slide contact portion 68 which is brought into slide contact with the restricting portion 22A of the base member 15 is formed on the slide guide 60. With the formation of the slide contact portion 68, as shown in FIG. 7A to FIG. 9B, rattling of the handle grip 40 with respect to the base member 15 is suppressed, and manipulability of the handle grip 40 is enhanced.

(Detailed Description of Inserting Portion Body)

As shown in FIG. 2A and FIG. 2B, the inserting portion body 50 is formed with a size which allows a distal end of the inserting portion body 50 to be positioned in the guide hole 20 whichever of the two positions, the non-manipulation position or the manipulation position the handle grip 40 takes. To describe the configuration also with reference to FIG. 3, a manipulating portion 51 which engages with the manipulation receiving portion 32 and manipulates the lever member 30 is formed on a distal end of the inserting portion body 50. The manipulating portion 51 projects toward the shaft portions 19 along the longitudinal direction X. The projecting direction of the manipulating portion 51 is equal to the mounting direction of the handle grip 40 along which the handle grip 40 is mounted on the base member 15. A cut-away portion 52 is formed on the inserting portion body 50, and the manipulation receiving portion 32 of the lever member 30 which engages with the manipulating portion 51 is operably disposed in the cut-away portion 52. The cut-away portion 52 is formed on the inserting portion body 50 such that the cut-away portion 52 is recessed from a bearing portion 46 side of the inserting portion body 50 in a direction opposite to the bearing portion 46.

Figure 10A:
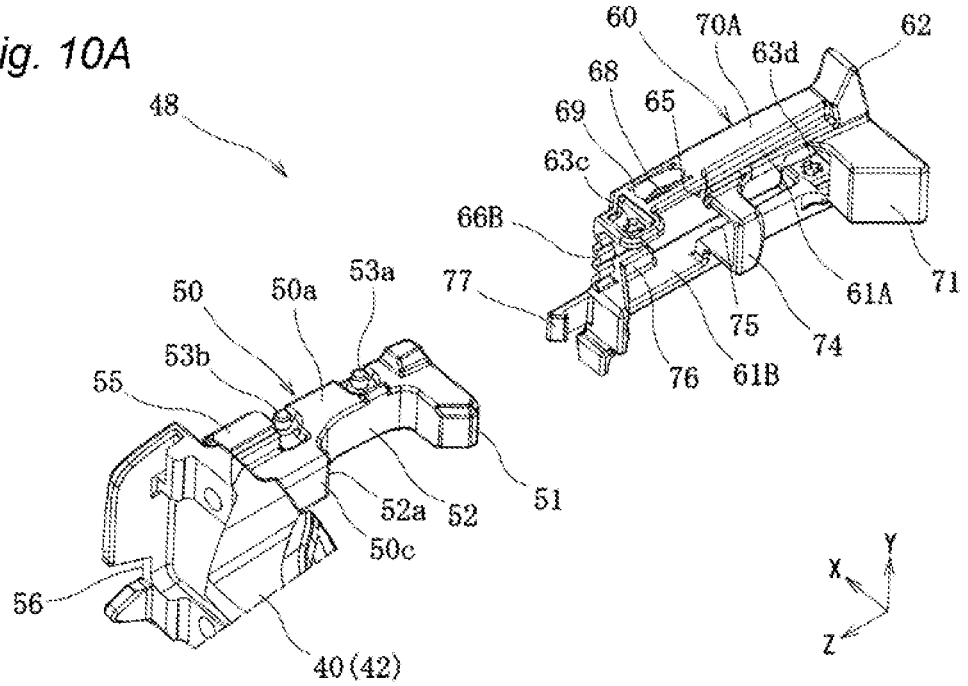
FIG. 10A is an exploded perspective view showing a state where an inserting portion and a slide guide of the handle grip are disassembled.
Figure 10B:
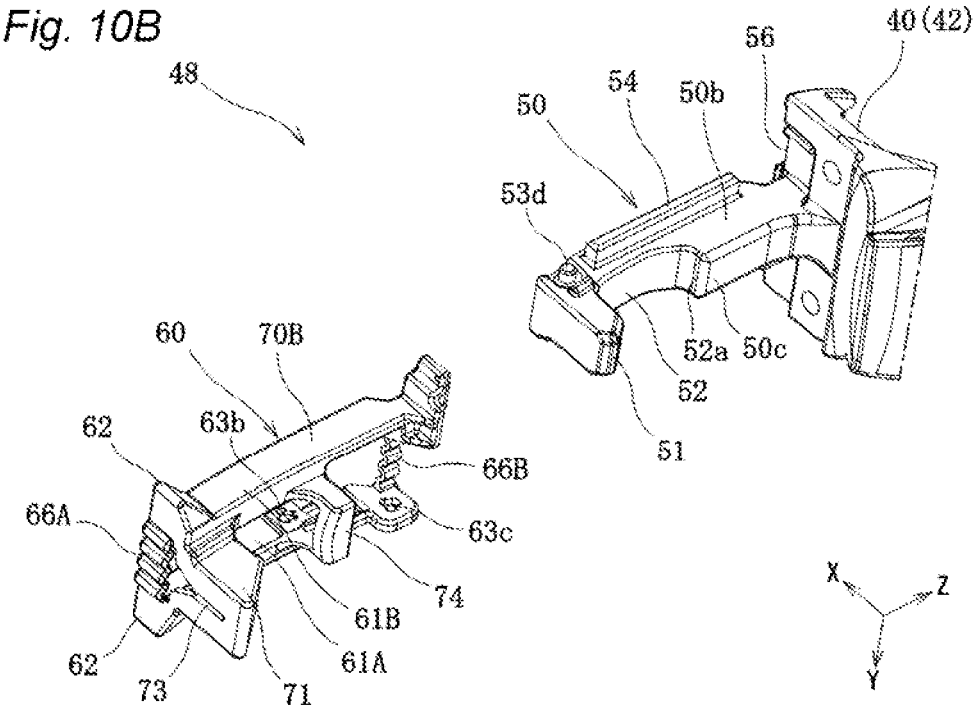
FIG. 10B is an exploded perspective view showing the state where the inserting portion and the slide guide of the handle grip are disassembled from a viewing angle different from a viewing angle of FIG. 10A.
Figure 11A:
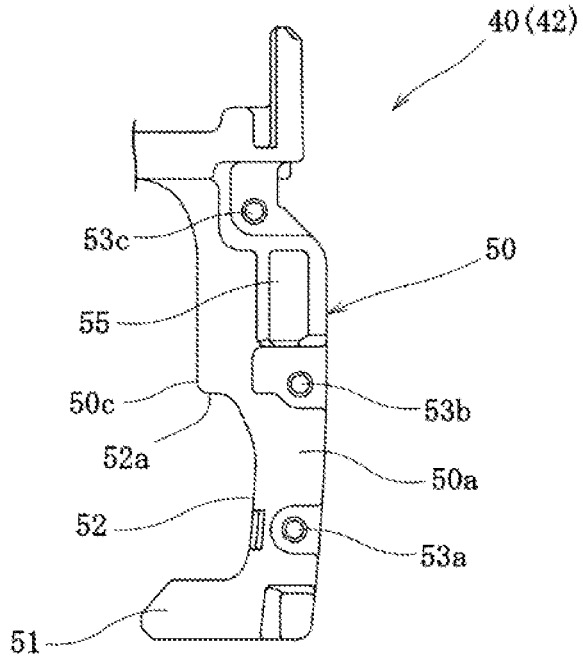
FIG. 11A is a plan view of the inserting portion of the handle grip.
Figure 11B:
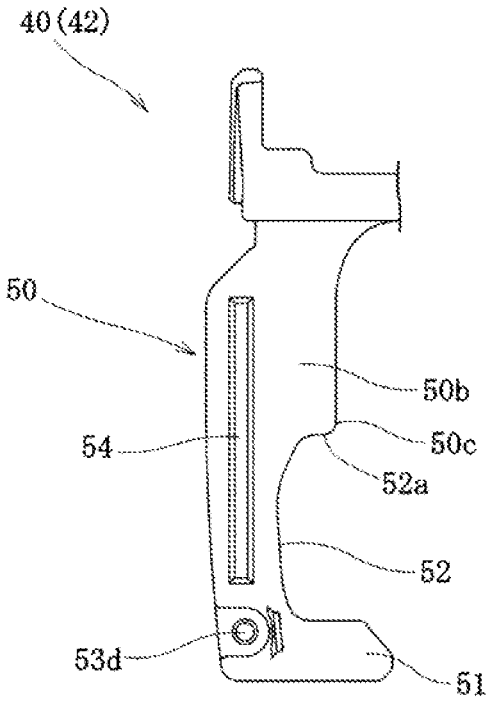
FIG. 11B is a bottom view of the inserting portion of the handle grip.

As shown in FIG. 10A to FIG. 11B, fixing convex portions (fixing portions) 53*a* to 53*d* for fixing the slide guide 60 are formed on the inserting portion body 50. Fixing convex portions 53*a* to 53*d* are formed on upper and lower surfaces of the inserting portion body 50 which opposedly face the restricting portions 22A, 22B of the base member 15 at four positions. To describe the configuration in detail, as shown in FIG. 10A and FIG. 11A, three fixing convex portions 53*a* to 53*c* are formed on the upper surface 50*a* of the inserting portion body 50 at predetermined intervals in the vehicle inside-and-outside direction Z along which the inserting portion body 50 projects. As shown in FIG. 10B and FIG. 11B, one fixing convex portion 53*d* is formed on a lower surface 50*b* of the inserting portion body 50 at a position on a distal end side of the inserting portion body 50. These fixing convex portions 53*a* to 53*d* project in the vertical direction Y which intersects with (is orthogonal to) the longitudinal direction X which is the mounting direction along which the handle grip 40 is mounted on the base member 15. The respective fixing convex portions 53*a* to 53*d* project in the direction which intersects with the vehicle inside-and-outside direction Z which is the direction in which the inserting portion 48 advances and retracts in the inside of the guide hole 20, and is also the direction in which the inserting portion 48 is inserted into the guide hole 20.

A positioning convex portion 54 which extends in a straight line shape along the vehicle inside-and-outside direction Z is formed on the lower surface 50*b* of the inserting portion body 50. In the same manner as the fixing convex portions 53*a* to 53*d*, the positioning convex portion 54 also projects in the vertical direction Y which intersects with the longitudinal direction X which is the mounting direction along which the grip body 42 is mounted on the base member 15. The positioning convex portion 54 is formed on the inserting portion body 50 such that the positioning convex portion 54 is positioned at a middle portion of the inserting portion body 50 with respect to the entire length of the inserting portion body 50. A projecting portion 55 which projects upwardly so as to have an approximately quadrangular shape is formed on the upper surface 50*a* of the inserting portion body 50 on a proximal end side of the inserting portion body 50.

(Detailed Description of Slide Guide)

To describe the configuration with reference to FIG. 12A to FIG. 13B together with FIG. 10A and FIG. 10B, the slide guide 60 includes: a pair of side frames 61A, 61B; and connecting portions 66A, 66B which connect these side frames 61A, 61B to each other. The slide guide 60 is made of a material which exhibits lower slide resistance against the restricting portions 22A, 22B of the base member 15 than against the inserting portion body 50 of the handle grip 40. For example, the base member 15 is made of glass-containing nylon, and the grip body 42 is made of glass-containing nylon. On the other hand, the slide guide 60 is made of polyester elastomer.

The side frames 61A, 61B are plate bodies which are disposed so as to overlap with the upper surface 50*a* and the lower surface 50*b* forming both sides of the inserting portion body 50 in the vertical direction Y in which the axis L of the bearing portion 46 extends. Stopper portions 62, 62 which project in the vertical direction Y are formed on distal ends of the side frames 61A, 61B. To describe the configuration with reference to FIG. 7A to FIG. 9A, a distance between outer ends of the stopper portions 62, 62 is substantially equal to the groove width H1 of the guide hole 20, and is larger than the groove width H2 between the restricting portions 22A, 22B. When the handle grip 40 is manipulated so as to open a door, the stopper portions 62, 62 are brought into slide contact with the upper wall 21*a* and the lower wall 21*b* thus preventing the handle grip 40 from being inclined in the vertical direction Y. Further, the stopper portions 62, 62 are brought into contact with the restricting portions 22A, 22B so that the removal of the inserting portion 48 from the guide hole 20 is prevented.

Figure 12A:
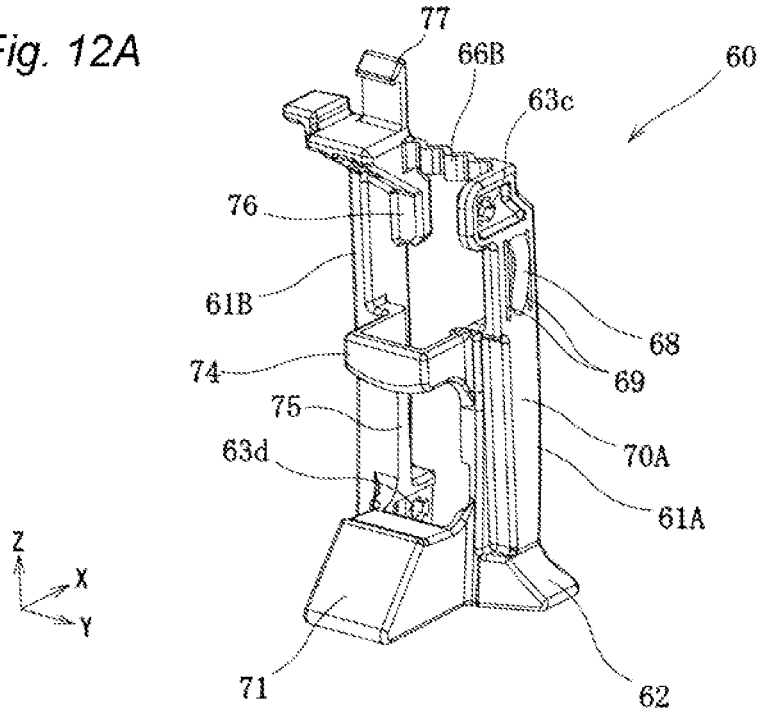
FIG. 12A is a perspective view of the slide guide.
Figure 12B:
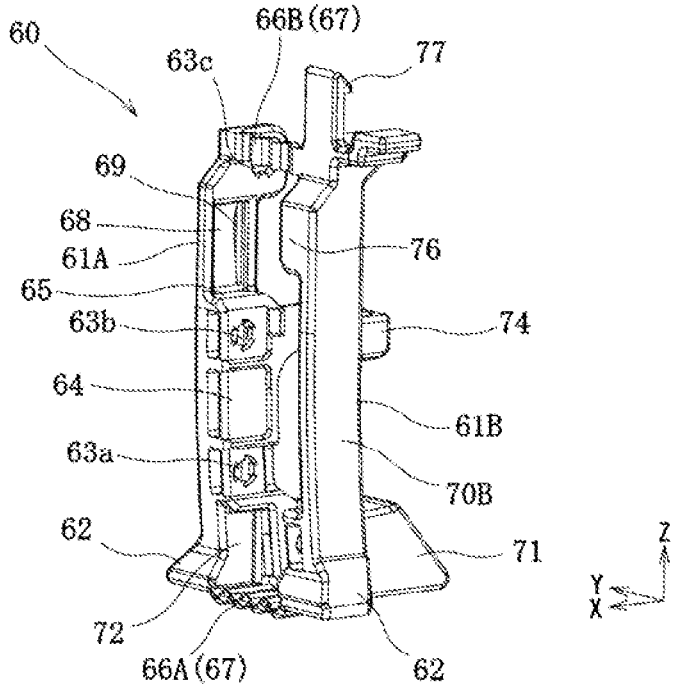
FIG. 12B is a perspective view of the slide guide as viewed from a direction different from a direction along which the slide guide is viewed in FIG. 12A.
Figure 14A:
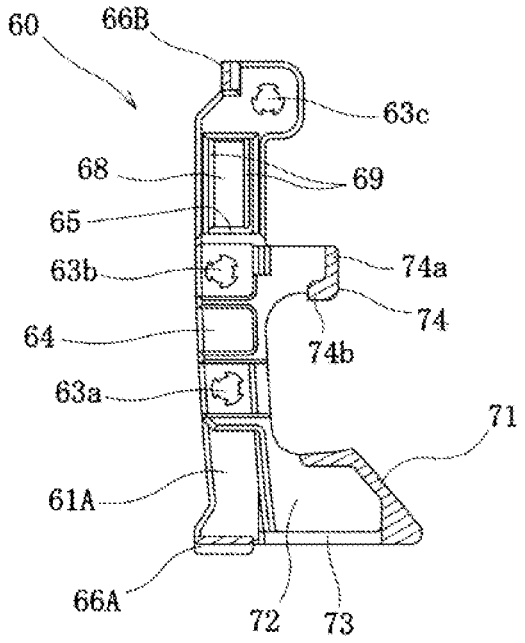
FIG. 14A is a cross-sectional view of the slide guide.
Figure 14B:
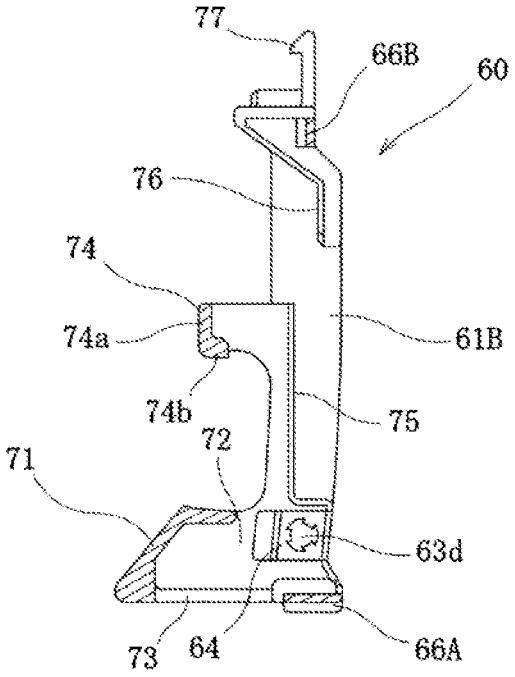
FIG. 14B is a cross-sectional view of the slide guide as viewed from a different direction from a direction along which the slide guide is viewed in FIG. 14A.

As shown in FIG. 12B and FIG. 14A, on the side frame 61A disposed on the upper surface 50*a* of the inserting portion body 50 in an overlapping manner, fixing concave portions (fixing portions) 63*a* to 63*c* which correspond to the fixing convex portions 53*a* to 53*c* are formed respectively. As shown in FIG. 12A and FIG. 14B, on the side frame 61B disposed on the lower surface 50*b* of the inserting portion body 50 in an overlapping manner, a fixing concave portion 63*d* which corresponds to the fixing convex portion 53*d* is formed. An inner wall portion 64 is formed on the inner surface side of the side frames 61A, 61B respectively, and the inner wall portions 64 are positioned with a gap formed therebetween. The fixing concave portions 63*a*, 63*b*, 63*d* are formed on the inner wall portions 64 of the side frames 61A, 61B. In this embodiment, the fixing concave portions 63*a* to 63*d* are respectively formed of a through hole formed in the inner wall portion 64 or in the side frame 61A. A positioning stepped portion 65 on which the projecting portion 55 formed on the inserting portion body 50 is disposed is formed on the proximal end side of the inner wall portion 64 of the side frame 61A.

As most clearly shown in FIG. 12B, the connecting portions 66A, 66B are formed on one ends and the other ends of the side frames 61A, 61B. The connecting portion 66A positioned on the distal end side of the inserting portion 48 is formed into a plate shape extending approximately along an XY plane, and connects distal-end-side end portions of the side frames 61A, 61B to each other. The connecting portion 66B positioned on the proximal end side of the inserting portion 48 is formed into a plate shape extending approximately along a YZ plane, and connects rear sides in the longitudinal direction X of the side frames 61A, 61B on the proximal end side to each other. On each of the connecting portions 66A, 66B, an extending and shrinking portion 67 formed of a concavo-convex portion having a bellows shape is formed. The extending and shrinking portion 67 allows the connecting portion 66A, 66B to extend and shrink in the vertical direction Y. In a state where a distance between the side frames 61A, 61B disposed on upper and lower sides is increased by the extending and shrinking portions 67, the side frames 61A, 61B are disposed outside the inserting portion body 50. Then, the respective side frames 61A, 61B are pressed in the direction Y in which the side frames 61A, 61B approach each other so that the fixing convex portions 53*a* to 53*d* are press-fitted into the fixing concave portions 63*a* to 63*d* respectively.

On the side frame 61A disposed on an upper side of the inserting portion body 50, the slide contact portion 68 which is brought into contact with the restricting portion 22A when the handle grip 40 is at the non-manipulation position and the contact portion 70A which can be brought into contact with the restricting portion 22A when the handle grip 40 is at the manipulation position are formed. On the side frame 61B disposed on a lower side of the inserting portion body 50, a contact portion 70B is formed. The contact portion 70B is brought into contact with the restricting portion 22B when the handle grip 40 is at the non-manipulation position, and can be brought into contact with the restricting portion 22B when the handle grip 40 is at the manipulation position.

Figure 7A:
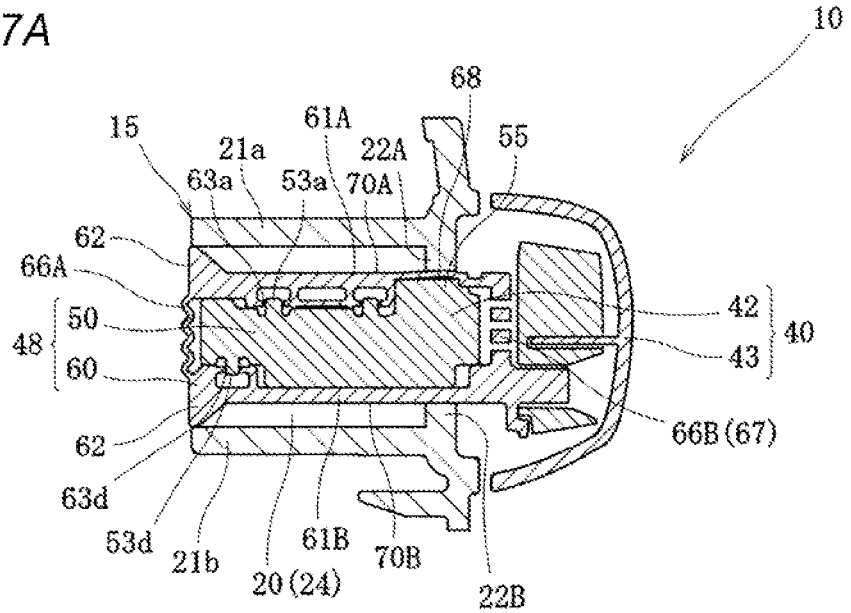
FIG. 7A is a cross-sectional view showing a state where the handle grip is at a non-manipulation position.
Figure 7B:
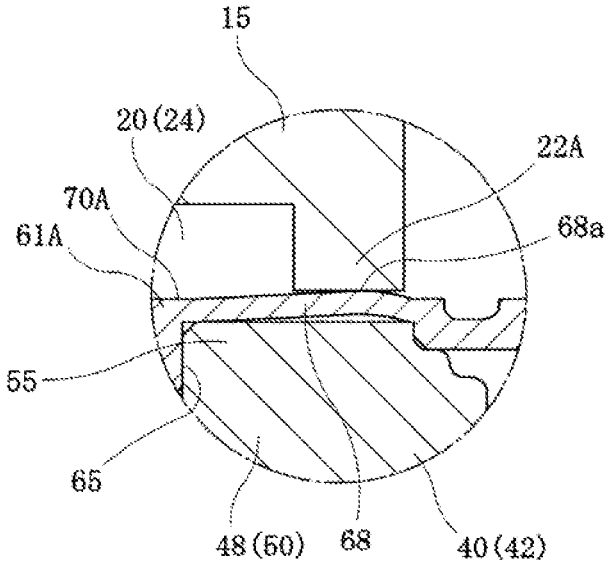
FIG. 7B is a partially enlarged cross-sectional view of the handle grip shown in FIG. 7A.

To describe the configuration with reference to FIG. 12A and FIG. 12B together with FIG. 7A and FIG. 7B, the slide contact portion 68 is formed only on the side frame 61A such that the slide contact portion 68 projects upward from the contact portion 70A disposed on the upper side. A pair of slits 69, 69 which extends parallel to each other in the vehicle inside-and-outside direction Z is formed in the side frame 61A so that the slide contact portion 68 is formed between the slits 69, 69. The slits 69, 69 are formed in the side frame 61A such that the slits 69, 69 extend toward the cabin side from positions of the side frame 61A which correspond to ends of the restricting portions 22A, 22B on the vehicle-outside side when the handle grip 40 is at the non-manipulation position.

The slide contact portion 68 has a curved surface shape which bulges upward between the slits 69, 69, and is elastically deformable in the vertical direction Y. As most clearly shown in FIG. 7B, the slide contact portion 68 has a top portion 68*a* at a position offset toward the vehicle-outside side of the inserting portion 48 such that the slide contact portion 68 is brought into contact with the restricting portion 22A in a state where the handle grip 40 is rotated to the non-manipulation position. With such a configuration, as shown in FIG. 8A to FIG. 9B, when the handle grip 40 is rotated from the non-manipulation position to the manipulation position, the slide contact portion 68 is positioned at a position where the slide contact portion 68 is not brought into contact with the restricting portion 22A. In this embodiment, the slide contact portion 68 is disposed at the position which corresponds to the positioning stepped portion 65 where the projecting portion 55 of the inserting portion body 50 is disposed. By arranging the projecting portion 55 of the inserting portion body 50 in the direction in which the slide contact portion 68 elastically deforms, excessive elastic deformation of the slide contact portion 68 is suppressed.

The contact portions 70A, 70B form outer side surfaces of the side frames 61A, 61B, and extend in the vehicle inside-and-outside direction Z which is the advancing and retracting direction of the inserting portion 48. The contact portion 70A forms a portion of the side frame 61A on the cabin side extending from the slide contact portion 68. The contact portion 70B forms the whole side frame 61B. The contact portions 70A, 70B are positioned with a distance therebetween which allows the contact portions 70A, 70B to be brought into contact with the restricting portions 22A, 22B of the base member 15 respectively in a state where the fixing convex portions 53*a* to 53*d* of the inserting portion body 50 are normally press-fitted into the fixing concave portions 63*a* to 63*d*.

Figure 9A:
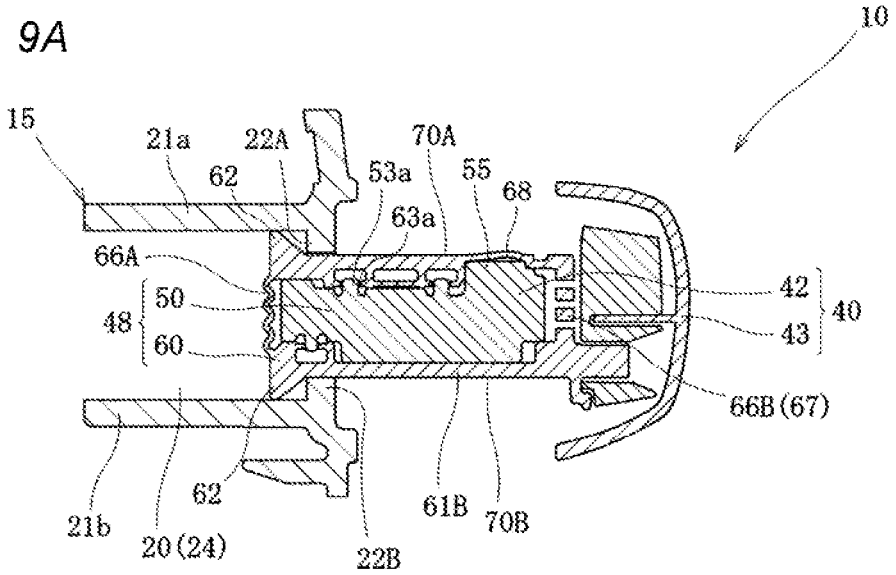
FIG. 9A is a cross-sectional view showing a state where the handle grip is at a manipulation position.
Figure 9B:
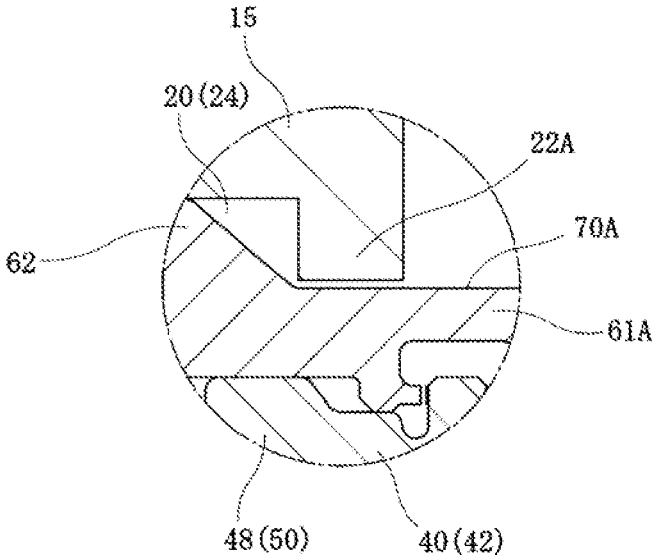
FIG. 9B is a partially enlarged cross-sectional view of the handle grip shown in FIG. 9A.

As shown in FIG. 7A and FIG. 7B, in a state where the handle grip 40 is rotated to the non-manipulation position, the slide contact portion 68 is brought into contact with the restricting portion 22A disposed on the upper side so that the contact portion 70B disposed on the lower side is brought into contact with the lower restricting portion 22B. As shown in FIG. 9A and FIG. 9B, when the handle grip 40 is rotated to the manipulation position, the contact between the slide contact portion 68 and the restricting portion 22A is released so that a gap which allows fine movement of the handle grip 40 is formed between the contact portion 70A and the restricting portion 22A and between the contact portion 70B and the restricting portion 22B respectively. When an external force in the vertical direction Y is applied to the handle grip 40 in such a manipulation position, the contact portions 70A, 70B are brought into contact with the restricting portions 22A, 22B which the contact portions 70A, 70B opposedly face and hence, the movement of the handle grip 40 is restricted.

As shown in FIG. 12A to FIG. 13B, a cover portion 71 which covers the manipulating portion 51 formed on a distal end of the inserting portion body 50 is integrally formed with a distal end of the slide guide 60 by molding. The cover portion 71 is continuously formed with distal ends of the pair of side frames 61A, 61B, and is formed into a hollow right-angled trapezoidal shape. An opening portion 72 which allows the insertion of the manipulating portion 51 is formed in the cover portion 71 on a proximal end side in the projecting direction X. To describe the configuration with reference to FIG. 13B to FIG. 14B, a slit 73 extending in the longitudinal direction X which is the direction in which the cover portion 71 projects is formed on a lower surface of the cover portion 71. With the formation of the slit 73, it is possible to ensure a state where the connecting portion 66A is extendable and shrinkable.

A center connecting portion 74 is formed on the slide guide 60. The center connecting portion 74 engages with the stepped portion 52*a* formed on a proximal end side of the cut-away portion 52 of the inserting portion body 50. The center connecting portion 74 is formed into a U shape and has end portions thereof continuously connected to middle portions of the pair of side frames 61A, 61B respectively. The center connecting portion 74 has an end surface portion 74*a* which is made to overlap with an end surface 50*c* of the inserting portion body 50 on a bearing portion 46 side, and an opposedly-facing surface 74*b* which opposedly faces the manipulating portion 51. By forming the center connecting portion 74 on the slide guide 60, it is possible to prevent the increase of the distance between the side frames 61A, 61B at a middle portion of the slide guide 60 so that excessive expansion of the connecting portions 66A, 66B disposed on both ends of the slide guide 60 can be suppressed. The center connecting portion 74 also plays a role of a guide portion at the time of mounting the slide guide 60 on the inserting portion body 50.

Figure 13A:
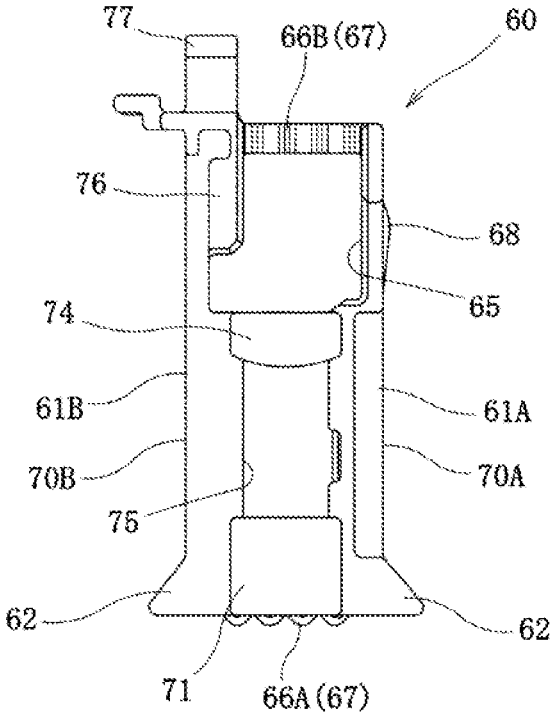
FIG. 13A is a front view of the slide guide.

As shown in FIG. 12A, FIG. 13B and FIG. 14B, a pair of positioning portions 75, 76 is formed on the side frame 61B of the slide guide 60. The positioning portions 75, 76 are brought into contact with the positioning convex portion 54 of the inserting portion body 50. The first positioning portion 75 is formed on a distal end side of the side frame 61B in the vehicle inside-and-outside direction Z (longitudinal direction) such that the first positioning portion 75 extends along the longitudinal direction. An end portion of the first positioning portion 75 on a proximal end side agrees with the position where the center connecting portion 74 is formed. The first positioning portion 75 is formed such that the first positioning portion 75 is positioned at an end portion of the side frame 61B in the longitudinal direction X (width direction), that is, at the end portion of the side frame 61B in the direction in which the cover portion 71 projects. The second positioning portion 76 is formed on the proximal end side of the side frame 61B in the vehicle inside-and-outside direction Z such that the second positioning portion 76 extends along the longitudinal direction. An end portion of the second positioning portion 76 on the distal end side is positioned such that a distance which allows the insertion of the positioning convex portion 54
is formed between the end portion of the second positioning portion 76 on the distal end side and an end portion of the first positioning portion 75 on the proximal end side. The second positioning portion 76 is also formed on the side frame 61B such that the second positioning portion 76 is positioned at the end portion of the side frame 61B on a side opposite to the first positioning portion 75 in the longitudinal direction X.

Figure 16A:
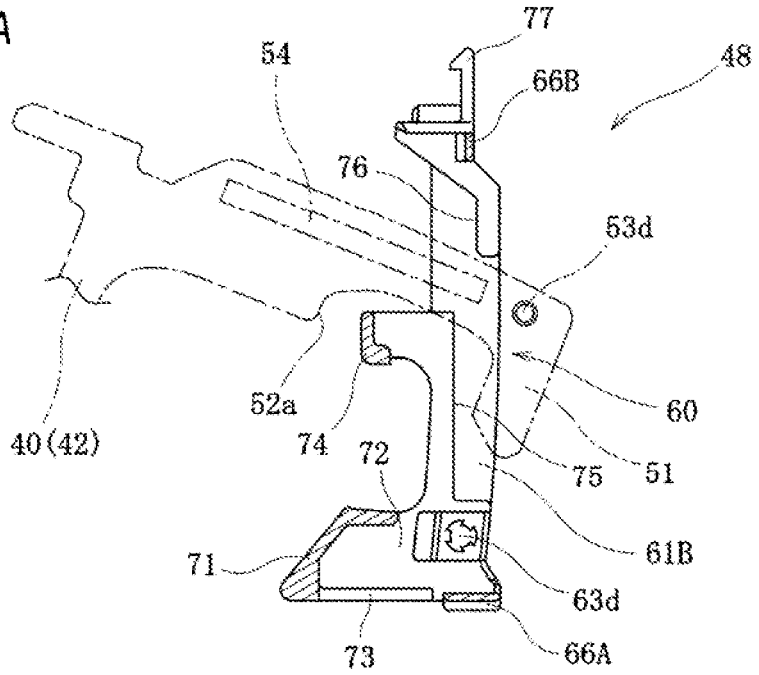
FIG. 16A is a cross-sectional view showing a state shown in FIG. 15B.
Figure 16B:
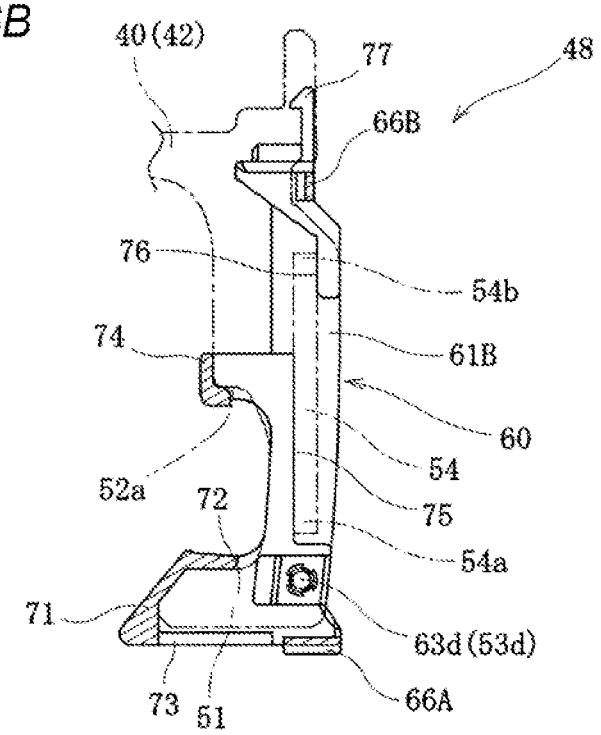
FIG. 16B is a cross-sectional view showing a state where the slide guide is mounted on the inserting portion.

As shown in FIG. 16B, in a state where the slide guide 60 is mounted on the inserting portion body 50, the first positioning portion 75 is brought into contact with a first side surface of the positioning convex portion 54 disposed on the distal end 54*a* side (one end side) of the positioning convex portion 54 and extending in the direction in which the manipulating portion 51 projects. The second positioning portion 76 is brought into contact with a second side surface of the positioning convex portion 54 disposed on the proximal end 54*b* side (the other end side) of the positioning convex portion 54 and on the side opposite to the first positioning portion 75. With such a configuration, the positioning convex portion 54 which is formed on the inserting portion body 50 in a projecting manner is positioned such that end surfaces of the positioning convex portion 54 in the longitudinal direction X are sandwiched between the first positioning portion 75 and the second positioning portion 76.

As shown in FIG. 4A, a locking pawl 77 is formed on the slide guide 60, and the locking pawl 77 projects outward from an end portion of the slide guide 60 on the vehicle-outside side. By mounting the slide guide 60 on the inserting portion body 50, the locking pawl 77 engages with an engaging-receiving portion 56 formed on the grip body 42. With such a configuration, the removal and the positional displacement of the slide guide 60 from the inserting portion body 50 are prevented.

(Assembling of Door Handle Device)

Figure 15A:
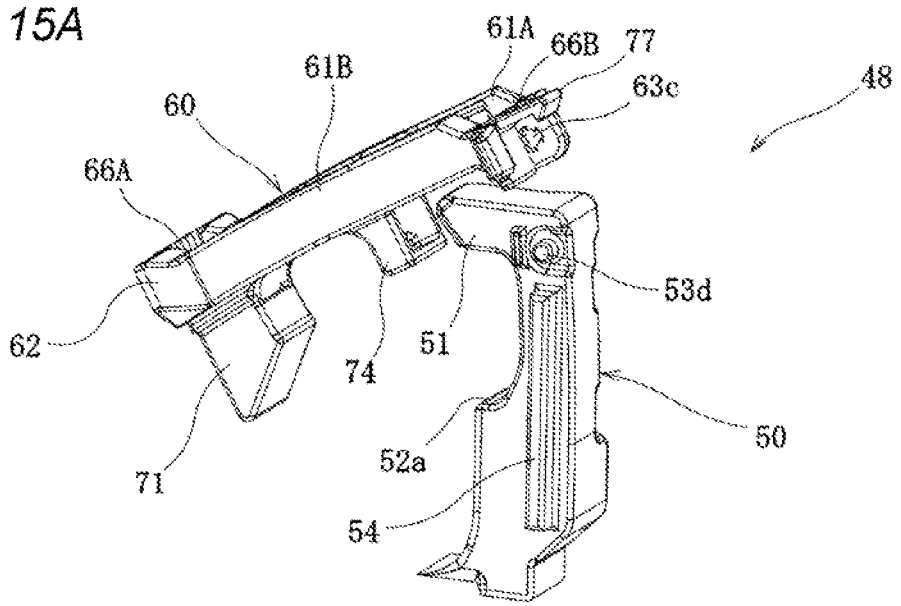
FIG. 15A is a perspective view showing a first step of mounting the slide guide on the inserting portion.
Figure 15B:
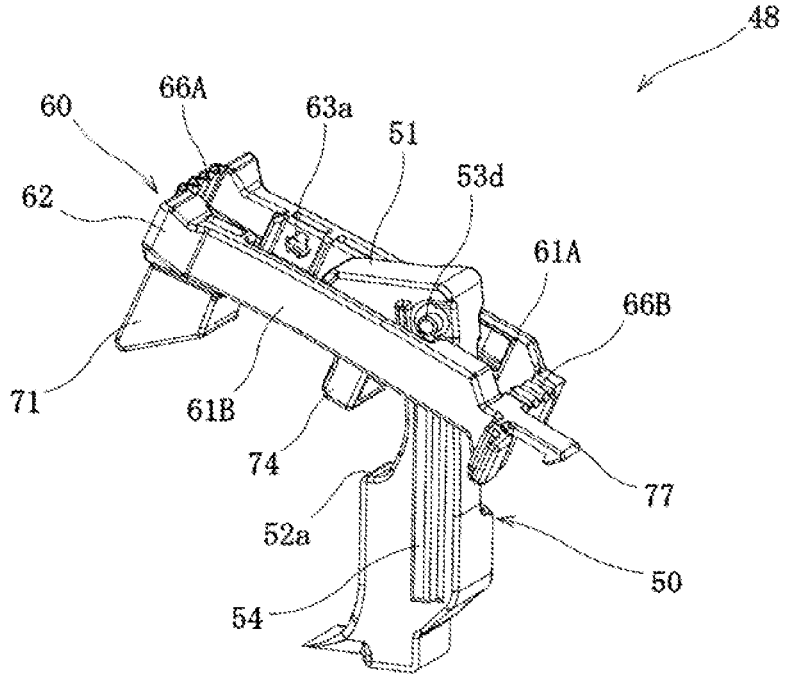
FIG. 15B is a perspective view showing a second step of mounting the slide guide on the inserting portion.

First, in mounting the slide guide 60 on the inserting portion body 50 of the grip body 42, as shown in FIG. 15A, the inserting portion body 50 is arranged on the side where the cover portion 71 of the slide guide 60 projects. Next, as shown in FIG. 15B and FIG. 16A, the manipulating portion 51 disposed on a distal end of the inserting portion body 50 is inserted into and made to pass through a space in the slide guide 60 surrounded by the pair of side frames 61A, 61B, the center connecting portion 74 and the connecting portion 66B.

Figure 15C:
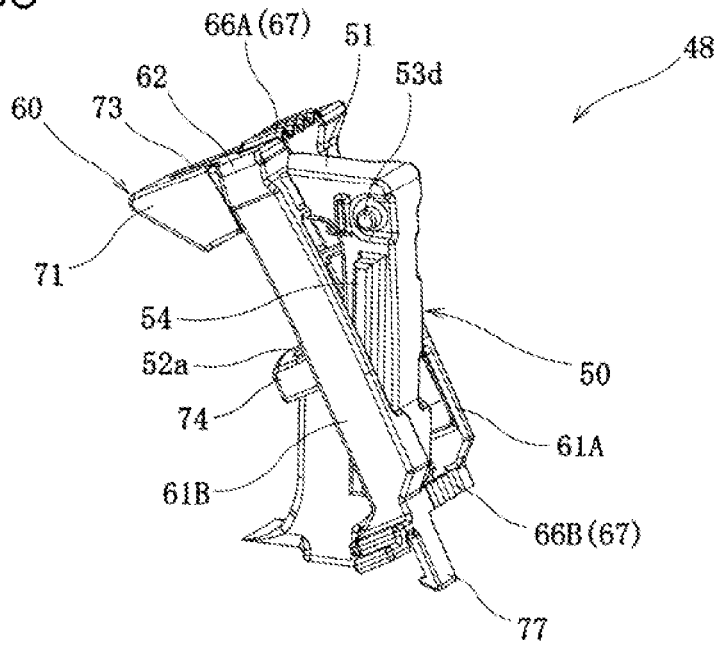
FIG. 15C is a perspective view showing a third step of mounting the slide guide on the inserting portion.

As shown in FIG. 15C, the insertion of the inserting portion body 50 into the slide guide 60 is stopped when the center connecting portion 74 and the stepped portion 52*a* are brought into contact with each other. In this state, the slide guide 60 and the inserting portion body 50 are rotated relative to each other about the stepped portion 52*a* which is brought into contact with the center connecting portion 74. With such steps, as shown in FIG. 16B, it is possible to make the slide guide 60 cover the inserting portion body 50 by extending and shrinking the extending and shrinking portions 67 disposed on both ends of the slide guide 60. Lastly, the pair of side frames 61A, 61B is pressed in the directions in which the side frames 61A, 61B approach each other and the fixing convex portions 53*a* to 53*d* are press-fitted into the fixing concave portions 63*a* to 63*d* respectively.

In this manner, due to the provision of the extending and shrinking portions 67 formed on the connecting portions 66A, 66B, the slide guide 60 can be shifted in the direction in which the distance between the pair of side frames 61A, 61B is expanded and in the direction in which the distance between the pair of side frames 61A, 61B is shrunken. Accordingly, it is possible to ensure a space for press-fitting the fixing convex portions 53*a* to 53*d* of the inserting portion body 50 into the fixing concave portions 63*a* to 63*d* of the slide guide 60. As a result, it is possible to enhance operability in mounting the slide guide 60 on the inserting portion body 50 of the handle grip 40.

To describe the configuration with reference to FIG. 16B together with FIG. 7A, in a state where the slide guide 60 is mounted on the inserting portion body 50 of the grip body 42, the pair of side frames 61A, 61B is disposed on the upper and lower surfaces 50*a*, 50*b* of the inserting portion body 50 in an overlapping manner. The manipulating portion 51 of the inserting portion body 50 is disposed in the inside of the cover portion 71 by insertion, and the stepped portion 52*a* engages with the center connecting portion 74. Further, a state is provided where the positioning convex portion 54 is sandwiched between the first positioning portion 75 and the second positioning portion 76. Accordingly, even when an external force is applied to the slide guide 60, there is no possibility that the slide guide 60 is easily removed from the inserting portion 48.

Next, the handle grip 40 on which the slide guide 60 is mounted is mounted on the base member 15 mounted on the door panel 1 on the cabin side. To be more specific, the arm portion 45 of the grip body 42 is inserted into the arm mounting hole 18 formed in the base member 15 through the first opening portion 2 from the vehicle-outside side. On the other hand, the inserting portion 48 of the handle grip 40 is inserted into the insertion allowing portion 23 of the guide hole 20 formed in the base member 15 through the second opening portion 3 from the vehicle-outside side. In this embodiment, the fixing convex portions 53*a* to 53*d* formed on the inserting portion body 50 project in the direction Y which intersects with the direction Z in which the inserting portion 48 is inserted into the insertion allowing portion 23. Accordingly, even when the slide guide 60 interferes with the surrounding walls 21*a* to 21*d* of the guide hole 20, there is no possibility that the slide guide 60 is removed from the inserting portion body 50.

In a state where the arm portion 45 is inserted into the arm mounting hole 18 and the inserting portion 48 is inserted into the insertion allowing portion 23 of the guide hole 20, the bearing portions 46 of the arm portion 45 and the shaft portions 19 of the base member 15 are positioned with a predetermined distance therebetween in the longitudinal direction X. In this state, the handle grip 40 is slid with respect to the base member 15 along the longitudinal direction X so that the bearing portions 46 are mounted on the shaft portions 19 in a rotatable manner. Accordingly, as shown in FIG. 2A and FIG. 7A, the inserting portion 48 is moved from the insertion allowing portion 23 of the guide hole 20 to the guide portion 24 where the restricting portions 22A, 22B project and is disposed at the guide portion 24. The manipulating portion 51 of the inserting portion 48 is positioned such that the manipulating portion 51 is engageable with the manipulation receiving portion 32 of the lever member 30 on the cabin side. In this embodiment, the fixing convex portions 53*a* to 53*d* of inserting portion body 50 project in the direction Y which intersects with the direction X in which the bearing portions 46 are mounted on the shaft portions 19. Accordingly, even when the slide guide 60 interferes with the restricting portions 22A, 22B, there is no possibility that the slide guide 60 is removed from the inserting portion body 50.

By mounting the handle grip 40 on the base member 15 fixed to the door panel 1 in this manner, the assembling of the door handle device 10 is completed.

(Operation of Door Handle Device)

As shown in FIG. 2A, FIG. 7A and FIG. 7B, in a state where the handle grip 40 is rotated to the non-manipulation position, the slide contact portion 68 of the inserting portion 48 of the handle grip 40 is elastically brought into contact with the restricting portion 22A of the base member 15. With such an elastic contact, the inserting portion 48 is biased downward so that the contact portion 70B positioned on a side opposite to the slide contact portion 68 is brought into contact with the restricting portion 22B. Accordingly, the inserting portion 48 of the handle grip 40 which is disposed between the restricting portions 22A, 22B of the base member 15 is brought into pressure contact with both the restricting portions 22A, 22B. As a result, rattling of the handle grip 40 in the vertical direction can be suppressed.

Usually, a user grips the handle grip 40 from above and hence, a downward load is applied to the handle grip 40. In such an operation, there is no gap below the inserting portion 48 of the handle grip 40 in a non-manipulating state and hence, the handle grip 40 is maintained in a state where the position of the handle grip 40 is restricted by the restricting portions 22A, 22B. Accordingly, even when an external force in the vertical direction is applied to the handle grip 40 at the non-manipulation position, there is no possibility that the user who grips the handle grip 40 receives a sensation of rattling. Further, even when the user moves the handle grip 40 in the lower direction in a state where the handle grip 40 is at the non-manipulation position, the slide contact portion 68 having elasticity is brought into contact with the restricting portion 22A of the base member 15 and hence, rattling can be suppressed.

Figure 8A:
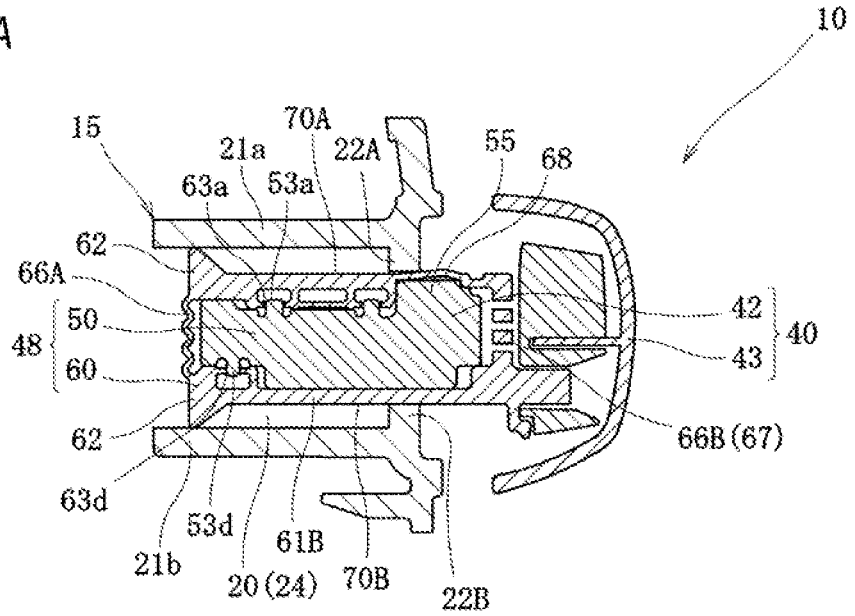
FIG. 8A is a cross-sectional view showing a state of the handle grip in a manipulation step.
Figure 8B:
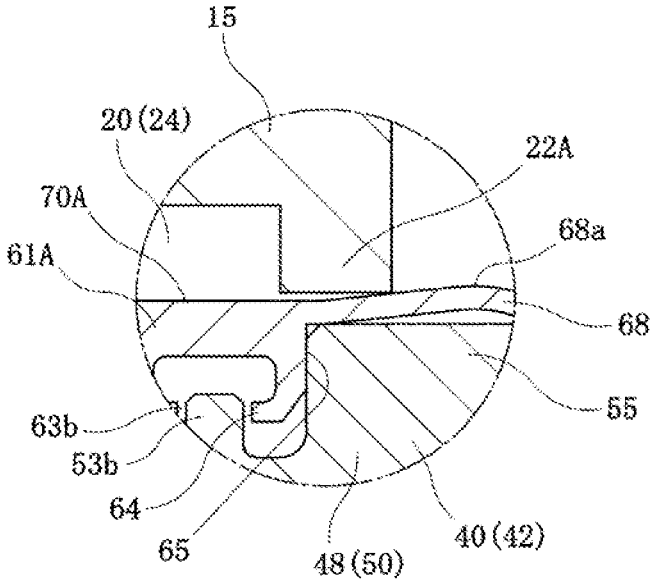
FIG. 8B is a partially enlarged cross-sectional view of the handle grip shown in FIG. 8A.

As shown in FIG. 8A and FIG. 8B, when the handle grip 40 is manipulated in the vehicle-outside direction Z so as to open the door, the inserting portion 48 is moved in the vehicle-outside direction Z along the guide hole 20. With such an operation, an elastic contact of the slide contact portion 68 with the restricting portion 22A is gradually released while the slide contact portion 68 is brought into slide contact with the restricting portion 22A. When the slide contact portion 68 is separated from the restricting portion 22A and the contact portion 70A is disposed at the position where the contact portion 70A opposedly faces the restricting portion 22A, the pressure contact state between the inserting portion 48 and the restricting portions 22A, 22B is released. Accordingly, slide resistance of the handle grip 40 against the base member 15 can be reduced. As a result, it is possible to prevent manipulability of the handle grip 40 from being impaired.

As shown in FIG. 2B, FIG. 9A and FIG. 9B, when the manipulation receiving portion 32 of the lever member 30 is brought into contact with the restricting portions 22A, 22B, the manipulation of the handle grip 40 in the vehicle-outside direction Z is restricted. When the handle grip 40 is at such a manipulation position, the contact portions 70A, 70B of the inserting portion 48 are positioned with a gap therebetween such that the contact portions 70A, 70B can be brought into contact with the restricting portions 22A, 22B of the base member 15. In this embodiment, an axis of rotation L of the handle grip 40 extends in the vertical direction Y and hence, the contact portion 70B disposed on the lower side is brought into contact with the restricting portion 22B which the contact portion 70B opposedly faces, and the contact portion 70A disposed on the upper side is positioned with a distance between the contact portion 70A and the restricting portion 22A. Accordingly, even when a downward load is applied to the handle grip 40 at such a manipulation position, breakage of the shaft portion 19 or the bearing portion 46 can be prevented. When the handle grip 40 is manipulated, the contact portion 70B is brought into slide contact with the restricting portion 22B and hence, there is no possibility that manipulability of the handle grip 40 is impaired.

When the user releases his hand from the handle grip 40, the handle grip 40 is rotated in the cabin side direction Z by a biasing force of the return spring 35 of the lever member 30. In this case, a gap is formed between the inserting portion 48 of the handle grip 40 and the restricting portions 22A, 22B and hence, there is no possibility of a return failure which may be caused due to slide resistance between these portions. Then, the handle grip 40 is brought into contact with the base member 15 or the door panel 1 so that the rotation of the handle grip 40 in the cabin side direction Z is stopped at the non-manipulation position. With such an operation, the slide contact portion 68 of the inserting portion 48 of the handle grip 40 is brought into pressure contact with the restricting portion 22A so that the handle grip 40 is returned to a state where the contact portion 70B is elastically brought into contact with the restricting portion 22B.

As described above, in the door handle device 10 of this embodiment, the slide guide 60 having the slide contact portion 68 which is brought into slide contact with the restricting portion 22A of the base member 15 is disposed on the inserting portion 48 of the handle grip 40 and hence, rattling of the handle grip 40 with respect to the base member 15 can be prevented. Accordingly, by merely providing the fixing portions (fixing convex portions 53*a* to 53*d*) for fixing the slide guide 60 to the handle grip 40, the existing base member (existing product) 15 can be reused without making any change in design and hence, the increase of a manufacturing cost can be held in check at the time of changing a design of the handle grip 40.

The slide guide 60 is made of a material which exhibits lower slide resistance against the base member 15 than the grip body 42 does and hence, slide resistance at the time of manipulating the handle grip 40 can be reduced whereby the manipulability of the handle grip 40 can be enhanced with certainty. Further, the slide guide 60 which includes the pair of side frames 61A, 61B is formed into an integral body by the connecting portions 66A, 66B and hence, a part management is facilitated, and a manufacturing cost can be lowered. Further, the slide contact portion 68, the contact portions 70A, 70B, and the cover portion 71 are formed integrally with the slide guide 60 by molding and hence, it is possible to suppress the increase of the number of parts and the increase of a manufacturing cost. The manipulating portion 51 provided for manipulating the lever member 30 is covered by the cover portion 71 and hence, wear on the lever member 30 can be suppressed.

The door handle device of the present invention is not limited to the configuration described in the embodiments, and various modifications are conceivable.

Figure 17:
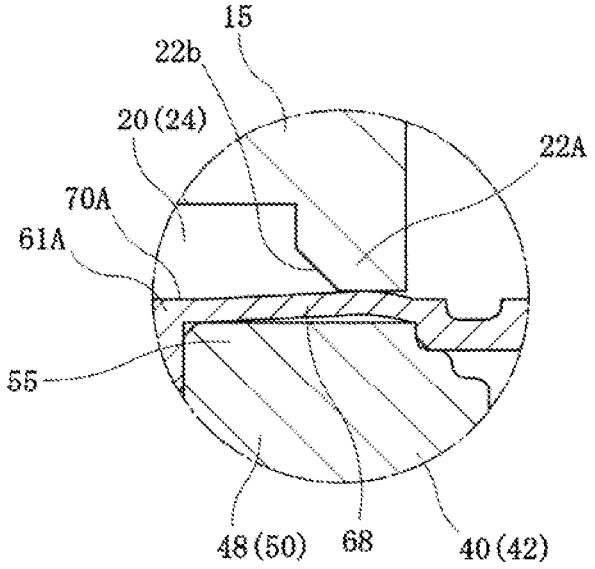
FIG. 17 is a cross-sectional view showing a modification of a door handle device.

For example, as shown in FIG. 17, a chamfered portion 22*b* may be formed on the restricting portion 22A of the base member 15 on the cabin side with which the slide contact portion 68 of the inserting portion 48 of the handle grip 40 is brought into slide contact. By forming the chamfered portion 22*b* on the restricting portion 22A, slide resistance between the slide contact portion 68 and the restricting portion 22A can be reduced and hence, manipulability of the handle grip 40 can be further enhanced.

The extending and shrinking portion 67 is formed over the whole connecting portion 66A, 66B in the above-mentioned embodiments. However, the extending and shrinking portion 67 may be formed on a part of the whole connecting portion 66A, 66B. The extending and shrinking portion 67 is formed on the pair of connecting portions 66A, 66B respectively. However, the extending and shrinking portion 67 may be formed only on either the connecting portion 66A or the connecting portion 66B. The extending and shrinking portion 67 is not formed on the center connecting portion 74. However, the extending and shrinking portion 67 may be further formed on the center connecting portion 74. Alternatively, the extending and shrinking portion 67 may be formed on none of connecting portions 66A, 66B, 74 which respectively connect the side frames 61A, 61B to each other.

In the above-mentioned embodiments, the slide contact portion 68 is configured to be elastically deformable by forming the pair of slits 69, 69 on the slide contact portion 68. However, the slide contact portion 68 may be configured to be elastically non-deformable by increasing a wall thickness of a portion of the side frame 61A disposed on the upper side. In the above-mentioned embodiments, the shaft portions 19 are formed on the base member 15, and the bearing portions 46 are formed on the handle grip 40. However, the bearing portions may be formed on the base member 15, and the shaft portions may be formed on the handle grip 40. It is needless to say that the configuration that the handle grip 40 is rotatably and pivotally supported by the base member 15 can be changed as desired.

In the above-mentioned embodiments, the handle grip 40 is rotated in the horizontal direction about the axis of rotation L extending in the vertical direction Y. However, the handle grip 40 may be rotated in the vertical direction about an axis of rotation extending in the longitudinal direction X. Further, in the above-mentioned embodiments, as the fixing portion for fixing the inserting portion body 50 of the handle grip 40 and the slide guide 60 to each other, the fixing convex portions 53*a* to 53*d* are formed on the inserting portion body 50, and the fixing concave portions 63*a* to 63*d* are formed on the slide guide 60. However, fixing concave portions may be formed on the inserting portion body 50, and fixing convex portions may be formed on the slide guide 60. Further, the fixing portion is not limited to the combination of the convex portion and the concave portion, and the fixing portion can be changed as desired.

The slide contact portion 68 is made elastically deformable by forming the pair of slits 69, 69 on the slide contact portion 68. However, the slide contact portion 68 may be made elastically non-deformable by increasing a wall thickness of a portion of the side frame 61A disposed on the upper side. The inserting portion 48 includes the inserting portion body 50 of the grip body 42 and the slide guide 60 which is a separate member from the inserting portion body 50. However, the inserting portion 48 may not include the slide guide 60. In this case, the slide contact portion 68 is formed on the grip body 42.

What is claimed is:

1. A door handle device comprising:

a base member having a first shaft portion or a first bearing portion formed on one end side thereof, and having a guide hole which has a restricting portion projecting into an inner space formed on the other end side thereof;

a handle grip having at least a second bearing portion or a second shaft portion which provides a rotatably mounting state for the handle grip between the first shaft portion or the first bearing portion of the base member, the second shaft portion or the second bearing portion formed on one end side thereof, and having an inserting portion advanceable into and retractable from the guide hole formed on the other end side thereof in a projecting manner; and a slide guide configured to be a separate body from the handle grip, attached to the inserting portion of the handle grip, and having a slide contact portion which is brought into slide contact with the restricting portion of the base member.

2. The door handle device according to claim 1, wherein one of the inserting portion and the slide guide of the handle grip has a fixing convex portion, and the other one has a fixing concave portion into which the fixing convex portion is press-fitted, a mounting direction along which the second bearing portion or the second shaft portion of the handle grip is mounted on the first shaft portion or the first bearing portion of the base member is the direction which intersects with the advancing and retracting direction of the inserting portion into and from the guide hole, and a press-fitting direction of the fixing convex portion into the fixing concave portion intersects with the mounting direction.

3. The door handle device according to claim 2, wherein the slide guide includes: a pair of side frames respectively disposed along a projecting direction of the inserting portion; and a connecting portion which connects the pair of side frames to each other, and the side frame has one of the fixing convex portion and the fixing concave portion.

4. The door handle device according to claim 3, wherein the connecting portion has an elastic portion.

5. The door handle device according to claim 3, wherein the inserting portion of the handle grip includes a positioning convex portion extending along a projecting direction of the inserting portion, the positioning convex portion being formed into a rectangular shape in cross section and having a first side surface and a second side surface, and the side frame of the slide guide has a first positioning portion which is brought into contact with the first side surface of the positioning convex portion on one end side, and a second positioning portion which is brought into contact with the second side surface of the positioning convex portion on the other end side.

6. The door handle device according to claim 1, wherein the handle grip is rotatable about the shaft portion between a non-manipulation position where the handle grip extends along the base member and a manipulation position where the handle grip is away from the base member, and the slide contact portion of the slide guide is elastically brought into contact with the restricting portion when the handle grip is at the non-manipulation position, and the slide contact portion of the slide guide is brought into a non-contact state with the restricting portion as the handle grip is rotated to the manipulation position.

7. The door handle device according to claim 6, wherein the base member and the handle grip are disposed such that an axis of the shaft portion extends along a vertical direction, and the slide contact portion is capable of being elastically brought into pressure contact only with an upper side of the inserting portion of the handle grip.

8. The door handle device according to claim 1 further comprising a biasing member which biases the handle grip to the non-manipulation position.

9. The door handle device according to claim 8, wherein the slide guide includes a contact portion which is capable of being brought into contact with the restricting portion of the base member along with the movement of the handle grip from the non-manipulation position to the manipulation position.

10. The door handle device according to claim 9, wherein the slide guide includes a pair of side frames disposed on both sides of the inserting portion, and a connecting portion which connects the pair of side frames to each other, and the side frame has the contact portion, and the slide contact portion which projects from the contact portion.

11. The door handle device according to claim 1, wherein the slide guide is made of a material which exhibits lower slide resistance against the restricting portion than the inserting portion exhibits.

12. The door handle device according to claim 1, wherein a manipulating portion which is configured to engage with a lever member rotatably and pivotally supported by the base member and to manipulate the lever member is mounted on the inserting portion of the handle grip, and a cover portion which covers the manipulating portion is integrally formed with the slide guide.

* * * * *